US007120938B2

(12) United States Patent
Ichigaya

(10) Patent No.: US 7,120,938 B2
(45) **Date of Patent: *Oct. 17, 2006**

(54) COOLING CLOTHS

(75) Inventor: Hiroshi Ichigaya, Saitama (JP)

(73) Assignee: Seft Development Laboratory Co., Ltd., Saitama (JP)

( * ) Notice: Subject to any disclaimer, the term of this patent is extended or adjusted under 35 U.S.C. 154(b) by 673 days.

This patent is subject to a terminal disclaimer.

(21) Appl. No.: 10/470,548

(22) PCT Filed: Jun. 15, 2001

(86) PCT No.: PCT/JP01/05145

§ 371 (c)(1),
(2), (4) Date: Jul. 30, 2003

(87) PCT Pub. No.: WO02/067708

PCT Pub. Date: Sep. 6, 2002

(65) Prior Publication Data

US 2004/0083526 A1 May 6, 2004

(30) Foreign Application Priority Data

Feb. 23, 2001 (WO) ..... PCT/JP01/01360

(51) Int. Cl.
*A41D 27/02* (2006.01)
*F25D 25/00* (2006.01)
*F28F 1/00* (2006.01)

(52) U.S. Cl. ..... 2/272; 2/458; 2/81; 2/97; 2/DIG. 3; 62/465; 162/168

(58) Field of Classification Search ..... 2/458, 2/81, 97, 272, DIG. 3; 62/259.3, 440, 465; 165/168, 172, 905, DIG. 46
See application file for complete search history.

(56) References Cited

U.S. PATENT DOCUMENTS 3,625,206 A * 12/1971 Charnley ..... 128/846
3,710,395 A * 1/1973 Spano et al. ..... 2/78.1
3,751,727 A * 8/1973 Shepard et al. ..... 2/2.14
3,892,225 A * 7/1975 Twose ..... 126/204
3,950,789 A * 4/1976 Konz et al. ..... 2/93
3,999,220 A * 12/1976 Keltner ..... 2/413
4,024,730 A * 5/1977 Bell et al. ..... 62/259.3

(Continued)

FOREIGN PATENT DOCUMENTS

JP 53-30910 3/1978

(Continued)

*Primary Examiner*—Gary L. Welch
*Assistant Examiner*—Robert H Muromoto, Jr.
(74) *Attorney, Agent, or Firm*—Rabin & Berdo, PC

(57) ABSTRACT

A cooling suit comprises: a cloth part; at least one spacer provided at a predetermined position of a reverse side of the cloth part, so as to ensure an airflow passage between the cloth part and a wearer's body; an air inlet provided at the cloth part so as to introduce air from the exterior into the airflow passage; an air outlet provided at the cloth part so as to take out the air within the airflow passage; a fan for forcibly causing an airflow within the airflow passage; and a battery for supplying an electric power to the fan.

50 Claims, 14 Drawing Sheets a b

U.S. PATENT DOCUMENTS 4,242,769 A * 1/1981 Rayfield et al. ..... 441/91
4,685,155 A * 8/1987 Fingerhut et al. ..... 2/272
5,222,548 A * 6/1993 Biggers et al. ..... 165/46
5,243,706 A * 9/1993 Frim et al. ..... 2/455
5,274,849 A * 1/1994 Grilliot et al. ..... 2/81
5,345,995 A * 9/1994 Yano et al. ..... 165/46
5,472,769 A * 12/1995 Goerz et al. ..... 428/138
5,774,902 A * 7/1998 Gehse ..... 2/458
5,970,519 A * 10/1999 Weber ..... 2/81
6,125,645 A * 10/2000 Horn ..... 62/259.3
6,516,624 B1 * 2/2003 Ichigaya ..... 62/259.3
6,619,382 B1 * 9/2003 Ichigaya ..... 165/80.3
6,757,916 B1 * 7/2004 Mah et al. ..... 2/456
6,779,592 B1 * 8/2004 Ichigaya ..... 165/46
6,786,273 B1 * 9/2004 Ichigaya ..... 165/46

FOREIGN PATENT DOCUMENTS

JP 62-276006 11/1987
JP 6-4011 1/1994
JP 3035862 1/1997
JP 11-158710 6/1999

* cited by examiner a b a b a b c

FIG. 5

| Comfortable Temperature(℃) of Each Testee | Average(℃) |
|---|---|
| 31.4 | |
| 32.8 | |
| 32.2 | |
| 32.0 | |
| 32.8 | |
| 31.1 | |
| 31.3 | |
| 31.1 | 31.5 |
| 31.1 | |
| 31.7 | |
| 30.8 | |
| 32.8 | |
| 30.7 | |
| 29.5 | |
| 31.3 | |

a b a b

COOLING CLOTHS

TECHNICAL FIELD

The present invention relates to a cooling suit for allowing to feel comfortableness even in environments at higher temperatures.

BACKGROUND ART

Currently, air conditioners are widespread most, as means for overcoming hotness in hot seasons such as summer. Such air conditioners are extremely effective in overcoming hotness, since they are to directly cool the air in the pertinent rooms.

However, air conditioners are so expensive that they have not been yet installed in every room of a household, though the spread rate of air conditioners to households has been increased in itself. Further, since air conditioners consume a lot of electric power, the spread of air conditioners: increases the electric power consumption of the whole society; and causes a disappointed result of warming the whole earth under the circumstances that the major part of power generation relies on fossil fuels. Moreover, air conditioners for directly cooling the air in the pertinent rooms may cause a problem of health damage due to overcooling.

Thus, the above problems will be solved to a certain extent, by working out such clothes for allowing to feel comfortableness even in hot seasons with a lesser power consumption.

DISCLOSURE OF THE INVENTION

The present invention has been carried out in view of such technical circumstances, and it is therefore an object of the present invention to provide a cooling suit for allowing to feel comfortableness even with a lesser power consumption and a simple structure.

To achieve the above object, the present invention provides a cooling suit to be worn on an upper body of a wearer, comprising: a cloth part; at least one spacer provided at a predetermined position of a reverse side of said cloth part, so as to ensure an airflow passage between said cloth part and the wearer's body when said cooling suit is worn by the wearer; an air inlet provided at said cloth part so as to introduce air from the exterior into said airflow passage; an air outlet provided at said cloth part so as to take out the air within said airflow passage; air-blowing means for forcibly causing an airflow within said airflow passage; and power source means for supplying an electric power to said air-blowing means; wherein the or each spacer is constituted to comprise a plurality of shaft-like members physically connected to one another, and the or each spacer has an opening ratio of 30% or more in the plane perpendicular to the air flowing direction.

Further, to achieve the above object, the present invention provides a cooling suit to be worn on an upper body of a wearer, comprising: a cloth part; at least one spacer provided at a predetermined position of a reverse side of said cloth part, so as to ensure an airflow passage between said cloth part and the wearer's body when said cooling suit is worn by the wearer; an air inlet provided at said cloth part so as to introduce air from the exterior into said airflow passage; an air outlet provided at said cloth part so as to take out the air within said airflow passage; air-blowing means for forcibly causing an airflow within said airflow passage; and power source means for supplying an electric power to said air-blowing means; wherein the or each spacer is constituted to comprise a plurality of shaft-like members physically connected to one another, and the or each spacer has an opening ratio of 30% or more in the plane perpendicular to the air flowing direction, and wherein said cooling suit is worn onto a naked skin or undergarment of the wearer such that the or each spacer directly contacts with the naked skin or undergarment at that side of the or each spacer which side is opposite to the side contacting with said cloth part.

Moreover, to achieve the above object, the present invention provides a cooling suit to be worn on an upper body of a wearer, comprising: a cloth part; at least one spacer provided at a predetermined position of a reverse side of said cloth part, so as to ensure an airflow passage between said cloth part and the wearer's body when said cooling suit is worn by the wearer; a lining cloth provided at that side of the or each spacer which side contacts with the wearer's body; an air inlet provided at said cloth part so as to introduce air from the exterior into said airflow passage; an air outlet provided at said cloth part so as to take out the air within said airflow passage; air-blowing means for forcibly causing an airflow within said airflow passage; and power source means for supplying an electric power to said air-blowing means; wherein the or each spacer is constituted to comprise a plurality of shaft-like members physically connected to one another, and the or each spacer has an opening ratio of 30% or more in the plane perpendicular to the air flowing direction, and wherein said cooling suit is worn onto a naked skin or undergarment of the wearer such that the or each spacer contacts, via said lining cloth, with the naked skin or undergarment at that side of the or each spacer which side is opposite to the side contacting with said cloth part.

In addition, to achieve the above object, the present invention provides a cooling suit to be worn on a lower body of a wearer, comprising: a cloth part; at least one spacer provided at a predetermined position of a reverse side of said cloth part, so as to ensure an airflow passage between said cloth part and the wearer's body when said cooling suit is worn by the wearer; an air inlet provided at said cloth part so as to introduce air from the exterior into said airflow passage; an air outlet provided at said cloth part so as to take out the air within said airflow passage; air-blowing means for forcibly causing an airflow within said airflow passage; and power source means for supplying an electric power to said air-blowing means; wherein the or each spacer is constituted to comprise a plurality of shaft-like members physically connected to one another, and the or each spacer has an opening ratio of 30% or more in the plane perpendicular to the air flowing direction.

Furthermore, to achieve the above object, the present invention provides a cooling suit to be unitedly worn on a wearer's body including an upper body and a lower body, comprising: a cloth part; at least one spacer provided at a predetermined position of a reverse side of said cloth part, so as to ensure an airflow passage between said cloth part and the wearer's body when said cooling suit is worn by the wearer; an air inlet provided at said cloth part so as to introduce air from the exterior into said airflow passage; an air outlet provided at said cloth part so as to take out the air within said airflow passage; air-blowing means for forcibly causing an airflow within said airflow passage; and power source means for supplying an electric power to said air-blowing means; wherein the or each spacer is constituted to comprise a plurality of shaft-like members physically connected to one another, and the or each spacer has an opening ratio of 30% or more in the plane perpendicular to the air flowing direction.

In addition, to achieve the above object, the present invention provides a cooling suit to be worn by a wearer, comprising: a cloth part; and at least one spacer provided at a predetermined position of a reverse side of said cloth part, so as to ensure an airflow passage between said cloth part and the wearer's body; wherein the or each spacer is constituted to comprise a plurality of shaft-like members physically connected to one another, and the or each spacer has an opening ratio of 30% or more in the plane perpendicular to the air flowing direction, and wherein said cooling suit is worn onto a naked skin or undergarment of the wearer such that the or each spacer directly contacts with the naked skin or undergarment at that side of the or each spacer which side is opposite to the side contacting with said cloth part.

In the cooling suit of the present invention, the cooling suit renders perspiration from the wearer's body to contact with the air flowing within the or each spacer so as to evaporate the perspiration from the wearer's body, to thereby utilize an effect to take away an evaporation heat from the surroundings upon the evaporation, thereby cooling the wearer's body. Note, the term "undergarment" means those garments to be worn inside or under the cooling suit.

It is preferable that the or each spacer has an opening ratio of 20% or more at the side of the or each spacer which contacts with the wearer's body.

BRIEF DESCRIPTION OF THE DRAWINGS

FIG. 5 is a table showing a result of an experiment for checking the temperature near a body surface for allowing a wearer to feel comfortableness;

BEST MODE FOR CARRYING OUT THE INVENTION

There will be described hereinafter the best mode for carrying out the present invention, with reference to the accompanying drawings. FIG. 1*a* is a schematic front view of a cooling suit according to an embodiment of the present invention, and FIG. 1*b* is a schematic rear view of the cooling suit.

Figure 1:
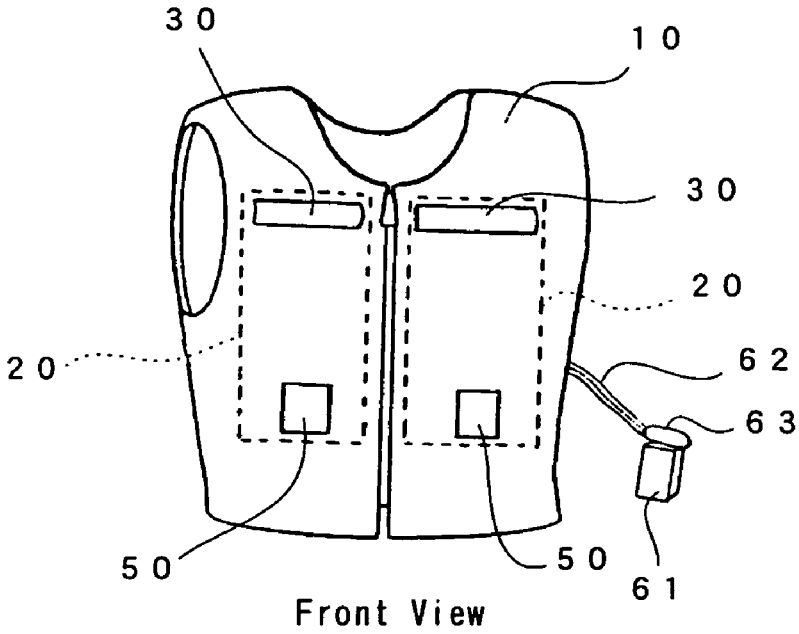
FIG. 1*a* is a schematic front view of a cooling suit according to an embodiment of the present invention.
FIG. 1*b* is a schematic rear view of the cooling suit.
Figure 1:
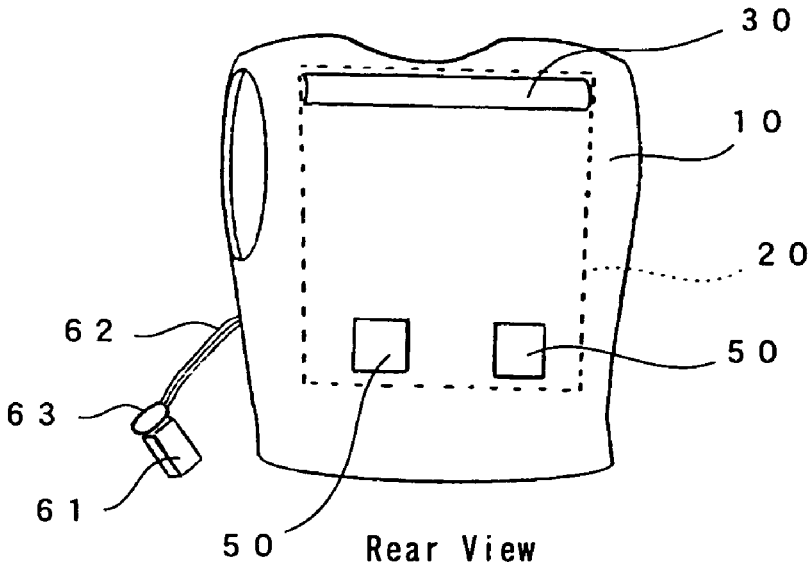

As shown in FIG. 1, the cooling suit of this embodiment comprises a cloth part 10, three spacers 20, three air inlets 30, four air outlets, four fans (air-blowing means) 50, a battery (power source means) 61, connection cords 62 and a battery attachment 63. Here, there will be described a situation where the cooling suit is applied to a vest. This vest is a type of closing the front by a fastener.

The cloth part 10 has a reverse side which is sewn or patched with three spacers 20 with thread. In this embodiment, the spacers 20 are sewn to those positions of the cloth part 10 which are susceptible to perspiration, respectively, such as a left thorax, right thorax and back. The spacers 20 are to ensure certain spaces between the cloth part 10 and a wearer's body. These spaces form airflow passages substantially parallel to body surfaces, when the cooling suit is worn by a wearer.

As means for closing the front portion of the worn cooling suit, this embodiment adopts a fastener. Although buttons and hooks will do, for example, fasteners are preferable. This is because fasteners are readily opened and closed, and substantially no air is leaked to the exterior once fasteners are closed. Thus, closing the fastener causes the two spacers 20 at the front side of the cloth part 10 to cooperatively constitute a single airflow passage.

The air inlets 30 are formed at those positions of the cloth part 10 which correspond to the vicinities of the upper ends of spacers 20, respectively. The lateral width of each air inlet 30 is substantially the same as that of the associated spacer 20. Each air inlet 30 is formed such as by cutting out a predetermined portion of the cloth part 10, and by sewing a mesh material into the cut out portion. This mesh material is provided to keep the associated spacer 20 from coming out, and to sew the upper end of the spacer 20 to the mesh material itself. The exterior air flows into the spacer 20 via air inlet 30. In the example of FIG. 1, the air inlets 30 are totally provided in three including two at the front side and one at the back side of the cooling suit.

There are further formed air outlets at predetermined positions of the cloth part 10, corresponding to the lower ends of the spacers 20, respectively. In FIG. 1, these air outlets are covered by fans 50 and thus invisible. These air outlets are also formed in the same manner as the air inlets 30. The number of air outlets is the same as that of fans 50. In the example of FIG. 1, air outlets are totally provided in four including two and two at the front and back sides of the cooling suit, respectively.

Figure 9:
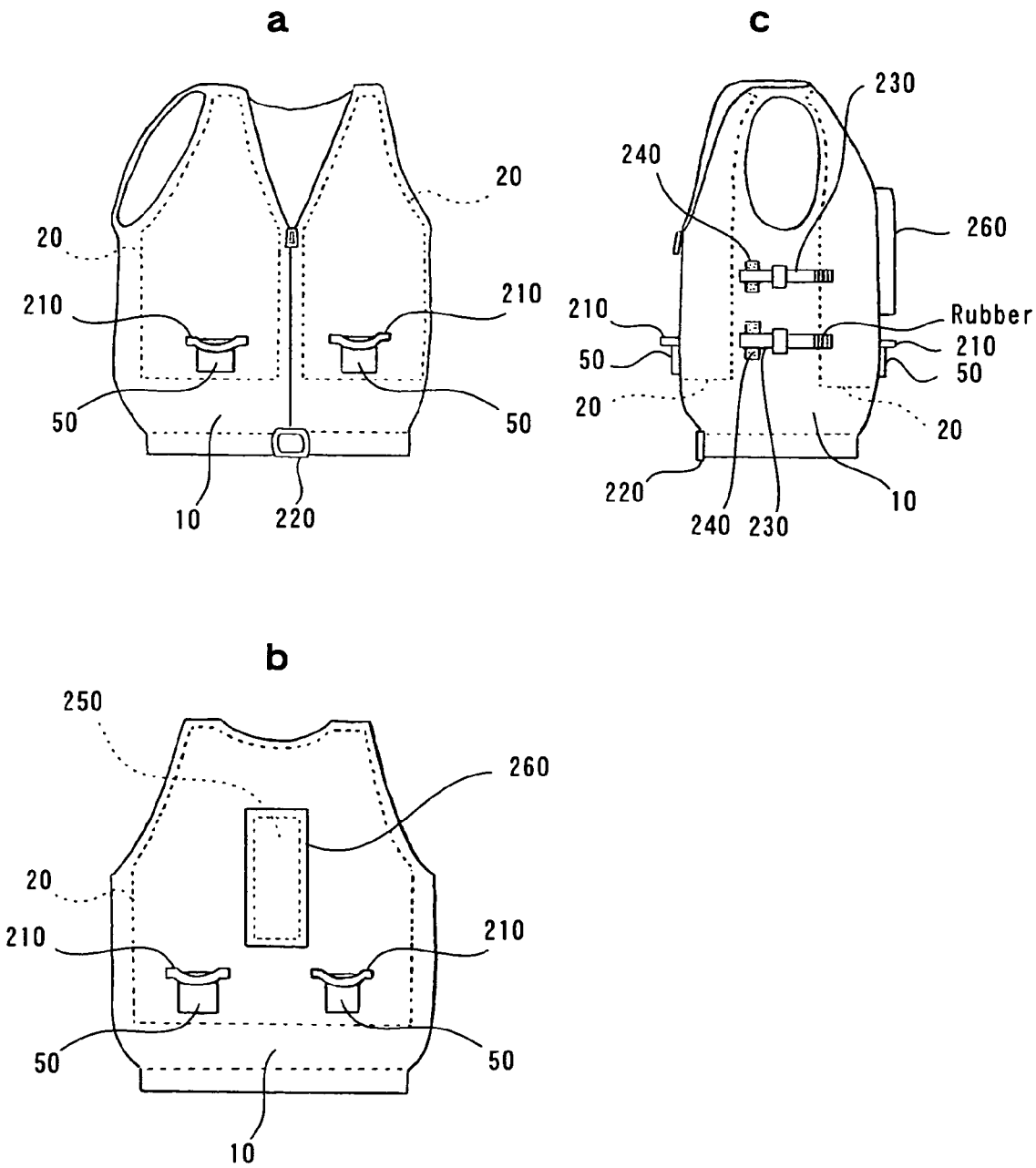
FIG. 9*a* is a schematic front view of a cooling suit according to another embodiment of the present invention.
FIG. 9*b* is a schematic rear view of the cooling suit.
FIG. 9*c* is a schematic side view of the cooling suit.

Note, instead of providing such air inlets 30, it is constitutionally possible to introduce air into the spacers 20, from predetermined ends of the cloth part 10 such as opening ends (gaps between the cooling suit and wearer's body) of spacers at the neck portion or the shoulder-to-axilla portions of the cloth part 10. Shown in FIG. 9 is an example of the cooling suit having such a constitution. In this case, it is required to extend the mounting positions of spacers 20 to the air introducing portions. In this way, it is not absolutely required to provide air inlets and air outlets, in case of utilizing the opening ends of spacers at the neck portion or axilla portions, as air inflow openings and outflow openings. For example, the example of FIG. 9 is provided with no air inlets.

Reverting to the subject, the fans 50 are mounted in a manner to cover the associated air outlets, so as to forcibly cause airflows within the spacers 20, respectively. Each fan 50 is an axial-flow fan which rotates in a direction for drawing out the air within the associated spacer 20 toward the exterior. Rotating each fan 50 in this direction reduces the pressure within the airflow passage formed by the associated spacer 20, to thereby cause the exterior air to flow into the airflow passage via associated air inlet 30. The introduced air moves along a downward direction, which is substantially parallel to the body surface within the associated airflow passage. Upon reaching the associated fan 50, the air is drawn by the fan 50 and discharged to the exterior. Note, used as each fan 50 is such a small fan having a size of 30 mm×30 mm and a thickness on the order of 5 mm.

The battery 61 acts as a power source for supplying an electric power to four fans 50. Here, the four fans 50 are parallelly connected, and the battery 61 is mounted to the battery attachment 63 provided at the ends of the connection cords 62 of the fans 50. Although FIG. 1 shows a state where the battery 61 is exposed on the cooling suit, the battery 61 is to be actually housed within a battery-aimed pocket formed at a predetermined position of the reverse side or outer side of the cooling suit. As the battery 61, it is preferable to adopt a secondary battery from an economical standpoint. In such a case, although the secondary battery may be detached from the battery attachment 63 and charged, it is also possible to provide the cloth part with a charging connector for connecting the secondary battery to an exterior power source upon charging such that the secondary battery is charged while mounted on the battery attachment 63.

Particularly, the fan 50 is detachably constituted in this embodiment. Concretely, there are provided magic tape pieces at the reverse side circumference of the frame of each fan 50 and at the corresponding circumference of the associated air outlet, and the fan 50 is mounted onto the circumference of the air outlet by using the magic tapes. Further, the fans 50 and connection cords 62 are connected by connectors, to thereby facilitate the mounting and detaching of the fan 50. As such, upon washing the cooling suit, the battery 61 is firstly detached from the cooling suit, the connection cords 62 are then pulled out of the fans 50, and finally the magic tapes are stripped off to thereby detach fans 50 from the cooling suit. In this way, the fans 50 and battery 61 can be readily detached, thereby allowing to anyone to readily wash the cooling suit. Note, the connection cords 62 are led around within the cloth part 10 of the cooling suit, thereby making it difficult to detach the connection cords 62 upon each washing. Thus, the connection cords 62 are rendered to be water resistant thereby allowing to wash the cooling suit with the connection cords 62 still attached thereto. Further, instead of the magic tapes, it is possible to adopt sheet-like magnets to attach and detach the fans 50.

Figure 10:
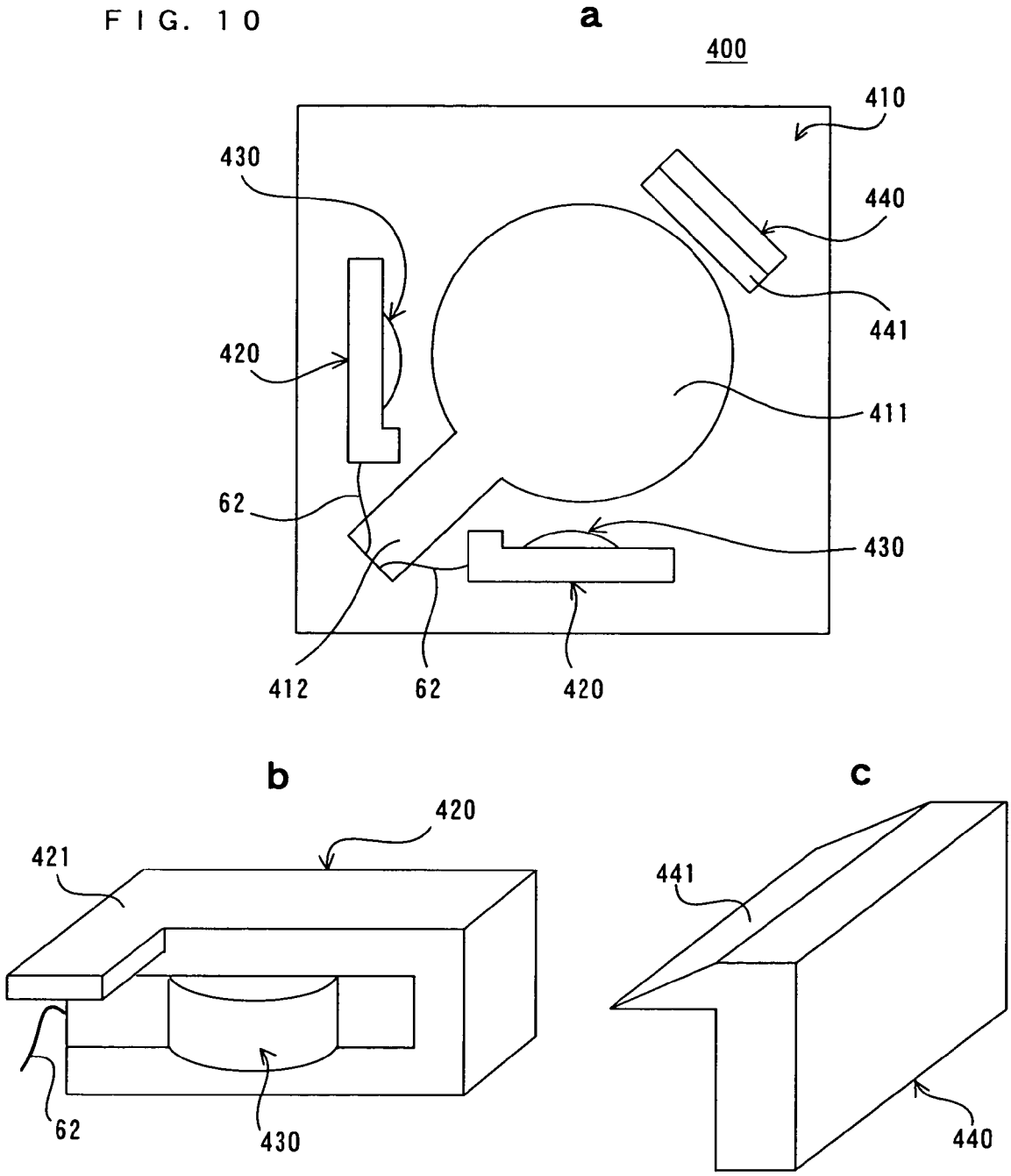
FIG. 10*a* is a schematic plan view of a specific fan holder.
FIG. 10*b* is a schematic perspective view of a first column of the fan holder.
FIG. 10*c* is a schematic perspective view of a second column of the fan holder.

Moreover, it is possible to constitute the fans in a detachable manner, making use of specific fan holders (holding means). This will be described hereinafter. FIG. 10*a* is a schematic plan view of the specific fan holder, FIG. 10*b* is a schematic perspective view of a first column of the fan holder, FIG. 10*c* is a schematic perspective view of a second column of the fan holder, FIG. 11*a* is a schematic plan view of a fan to be used in the specific fan holder, and FIG. 11*b* is a schematic side view of the fan. FIG. 10 shows a fan holder 400 including a square base plate 410, two first columns 420, 420, two electrodes 430, 430, and a second column 440. There are adopted plastics, for example, as the material of the base plate 410, first columns 420, 420, and second column 440.

The base plate 410 is a thin plate substantially centrally formed with a substantially circular vent hole 411. There is further formed a small opening 412 at a predetermined position of the base plate 410 near the vent hole 411. This opening 412 is to pass the connection cords 62 therethrough. The first columns 420 are to support the electrodes 430, respectively. Each of the first columns 420, 420 is mounted to the base plate 410 such that the side surface of the first column 420 confronts the vent hole 411 and the one end of the first column 420 is positioned near the opening 412. Formed at the upper portion of each first column 420 is a projection 421 protruded toward the vent hole 411. Each first column 420 has the substantially same height with the associated fan, so that its projection 421 acts to press the fan from the above.

Each electrode 430 is formed into a convex shape, and has elasticity. Each electrode 430 is mounted to the associated first column 420, so as to protrude the convex surface toward the vent hole 411. Each electrode 430 is connected to the battery 61 via associated connection cord 62. Further, the second column 440 is mounted at a side opposing to the opening 412 across the vent hole 411. This second column 440 has elasticity, and is formed at its upper portion with a projection 441 for pressing the fan from the above. Such a fan holder 400 is adhered to the cooling suit, such that the vent hole 411 is overlapped with the air outlet. The fan is clamped between the two electrodes 430, 430 and second column 440 which are elastic members.

Figure 11:
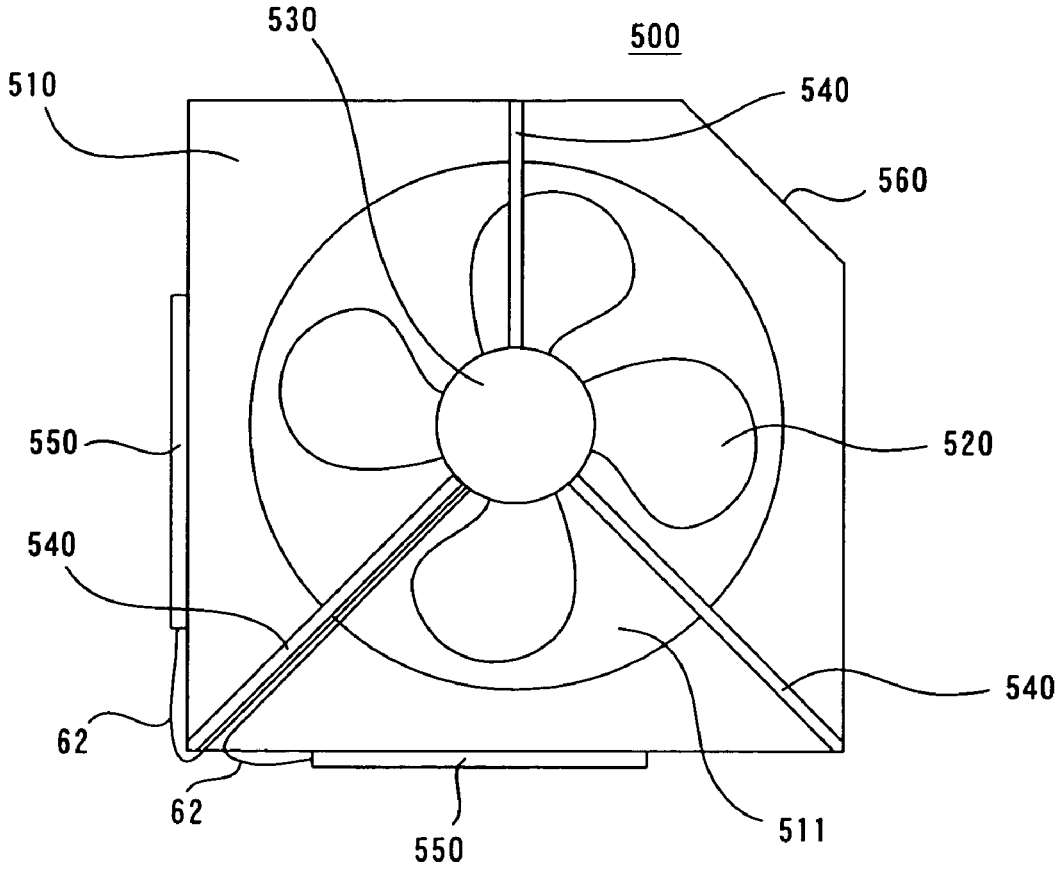
FIG. 11*a* is a schematic plan view of a fan to be used in the specific fan holder.
FIG. 11*b* is a schematic side view of the fan.
Figure 11:
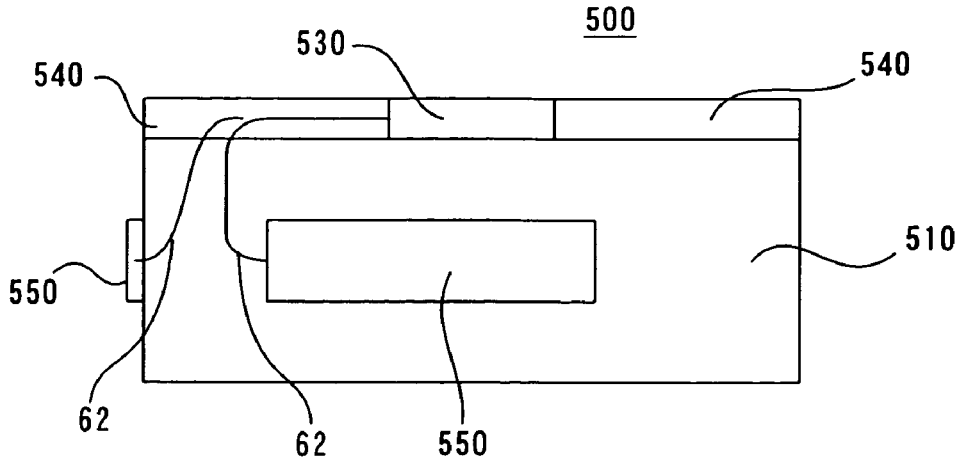

Meanwhile, there is used a fan 500 in this case, having a structure such as shown in FIG. 11. Such a fan 500 includes a frame 510, a vane portion 520, a circuit portion 530, three columns 540, 540, 540, two electrodes 550, 550, and a cutout portion 560. The frame 510 has a shape of substantial parallelepiped, and is substantially centrally formed with a large circular opening 511. The vane portion 520 and circuit portion 530 are provided within the opening 511, and the circuit portion 530 is held by the three columns 540, 540, 540. The circuit portion 530 also includes a rotative motor (driving means) attached with the vane portion 520. The two electrodes 550, 550 are adhered to the adjoining side surfaces of the frame 510. The two threads of connection cords 62 led out from the circuit portion 530 are connected to the electrodes 550, 550, respectively. Further, the cutout portion 560 is formed by cutting out that corner of the frame 510 opposing to the corner interposed between the electrodes 550, 550.

To mount the fan 500 onto the fan holder 400, the fan 500 is obliquely pushed toward the first columns 420, 420 so as to oppose the electrodes 550, 550 against the first columns 420, 420, respectively. Then, the second column 440 is elastically bent rearwardly, so as to push the fan 500 into the area surrounded by the first columns 420, 420 and second column 440. This causes the electrodes 430, 430 and second column 440 to abut onto the electrodes 550, 550 and cutout portion 560, respectively, and causes the fan 500 to be pressed by the projections 421, 441 from the above. Thus, the fan 500 is firmly held in the fan holder 400, and can be hardly detached easily. Herein, the fan 500 is to be supplied with an electric power via electrodes 430, 430. Meantime, the fan 500 can be detached, by elastically bending the second column 440 rearwardly and taking out the fan 500.

In this way, adopting the fan holder 400 shown in FIG. 10 and the fan 500 shown in FIG. 11 allows to readily attach and detach the fan.

Detachably constituting the fan in the above manner advantageously allows not only to readily wash the cooling suit but also to replace only the fan upon failure. Particularly, preparing various types of fans such as having different colors and/or air discharging abilities allows the wearer to attach that fan having his/her favorite color and/or having an air discharging ability suitable for the laboring environment.

Note, although the fan may get wet by rain, it is enough to apply a water resistant treatment to the circuit portion of the fan as a countermeasure. On the other hand, the wearer's back is a generally sweaty area whereas the thorax (or chest) and abdomen (or belly) are not so. Thus, the fans attached at the front side of the cooling suit may be provided with switches for turning on and off the fans, such that the wearer is to turn off these front fans to thereby cool his/her back only. The front surfaces of the fans are desirably provided with mesh members such as for avoiding entrance of fingers. Moreover, to make the fan unnoticeable, it is possible to attach a clear color mesh material to the fan itself.

Meanwhile, in case of wearing a jacket over the cooling suit adopting the axial-flow fan, the jacket blocks the air outlet of the axial-flow fan to thereby disturb the air discharge from the axial-flow fan. To avoid this problem, it is enough to attach a member outwardly protruded beyond the front surface of the fan, onto the fan or its surrounding portion. This allows: to ensure an air discharging space from the fan, even in wearing a jacket; and to prevent the fan to be hit by an exterior object and damaged. Concretely, as shown in FIG. 9, there are provided elastic members 210 so as to cover the above of the frames of axial-flow fans 50, respectively. The jacket is repelled by such elastic members 210, to thereby avoid blockage of the air discharging openings of axial-flow fans 50 by the jacket. Since the elastic members are provided only to repel the jacket, the elasticity of elastic members may be small. Further, the material for such members may be plastics.

In wearing a jacket such as a worksuit or a business suit, the front portion of the jacket is usually opened. However, such a jacket has a collar, thereby possibly making it difficult for air to flow into the spacer 20, via air inlet 30 provided at the upper portion of the back side of the cooling suit. To avoid that, it is enough, for example: to also provide the cooling suit with a collar, to thereby prevent the collar of the jacket from blocking the neck portion of the cooling suit; and, instead of providing the cooling suit with the air inlet(s) 30, to extend the spacer(s) 20 up to the collar end to thereby introduce air into the spacer(s) 20 from the neck portion.

Figure 12:
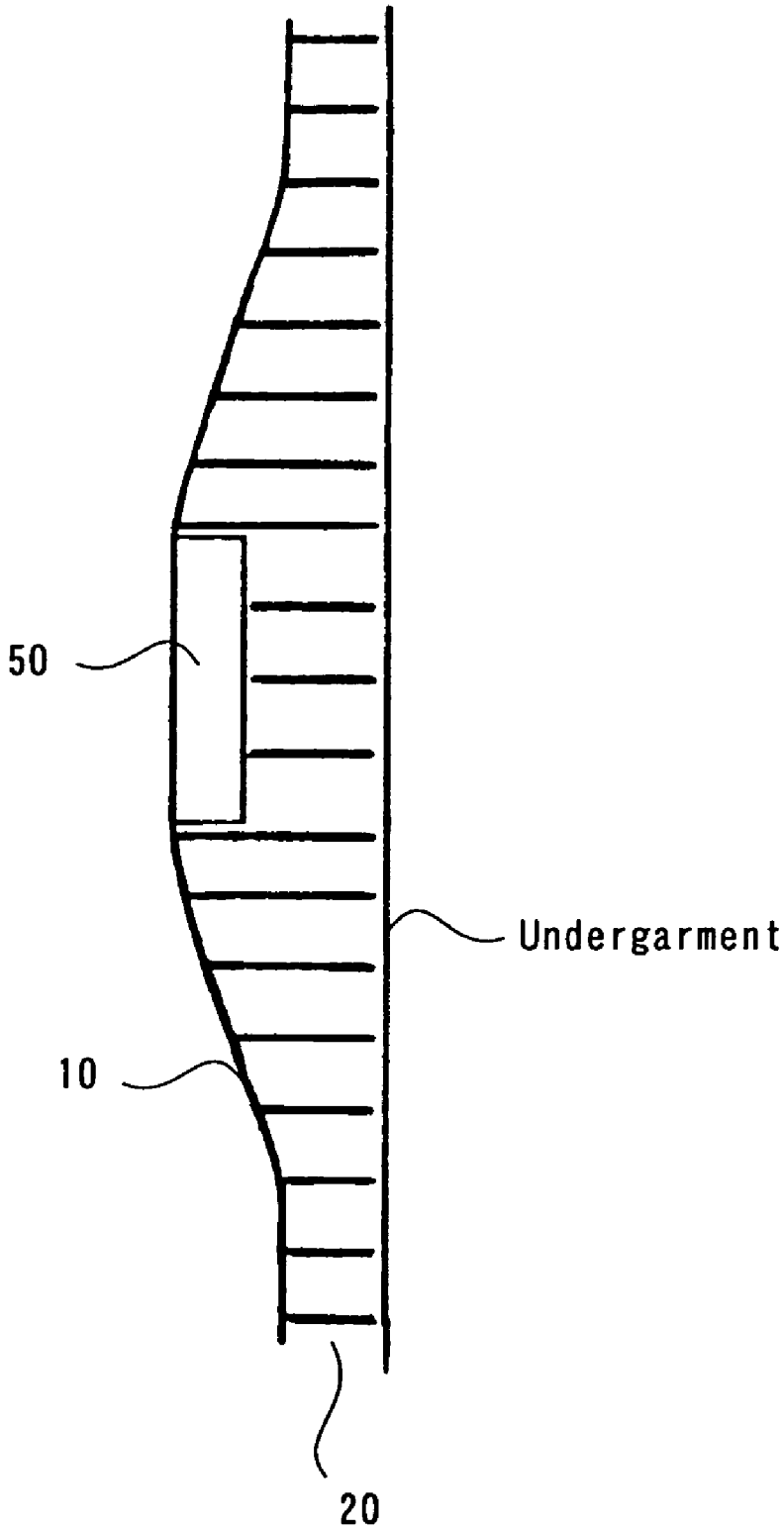
FIG. 12 is a view explaining another attaching procedure of the fan.

In adopting an axial-flow fan as the fan 50, someone may feel uneasiness in the appearance of the cooling suit, because the fan 50 is protruded from the cloth part 10. As shown in FIG. 12, to mitigate such uneasiness, it is enough to thicken the spacer 20 at the circumference around the position for attaching the fan 50, and to bury the fan 50 into the thus thickened spacer 20.

There will be hereinafter described the material for the cloth part 10. As the material for the cloth part 10, there is used a high density cotton cloth such as used as a cover cloth of a down jacket. The high density cotton cloth is woven at a density of about 300 threads per 1 cm, which is extremely high as compared with a typical cotton cloth. As described later, the cooling suit of this embodiment is to render the heat generated from the body surface to be absorbed by the air flowing through the airflow passage formed by the spacer 20. Thus, it is required to prevent the air from leaking via cloth part 10, in the course of flowing within the airflow passage. The high density cotton cloth has a higher density of threads so as to thereby extremely reduce the amount of air to be outwardly leaked through between the threads, thereby causing most of the air to pass through the airflow passage up to the air outlet and to be outwardly discharged therefrom. Thus, the high density cotton cloth is desirably used as the material for the cloth part 10. Further, the high density cotton cloth is strictly a cotton cloth having an advantage to be readily washed such as by a home washer when stained. Such a high density cotton cloth is readily available in a general garments shop.

As the material for the cloth part 10, it is possible to generally adopt any material which is substantially airtight, without limited to a cotton cloth such as the high density cotton cloth. The fan 50 to be used in this embodiment has an extremely low static pressure, so that the air is scarcely leaked partway. This allows to use general cloths such as made of silk or chemical fiber, as the cloth part 10. It is also possible to adopt a plastic sheet such as made of vinyl. Contrary, it is impossible to adopt those materials woven into a mesh shape, as a matter of course. However, it is possible to adopt a material having elasticity such as made of polyurethane called Spandex.

Particularly, in using the cooling suit upon working in a dirty environment, it is desirable to adopt, as the material of the cloth part 10, one having a smooth surface such as vinyl instead of a cotton cloth. This enables to readily clean the dirt. In this case, it is substantially impossible to outwardly emanate the moisture within the cooling suit through the cloth part 10. Nonetheless, this is not a problem, since the moisture is discharged outwardly together with the air flowing through the airflow passage by virtue of the fan 50.

There will be detailed hereinafter the structure of the spacer 20. FIG. 2*a* is a schematic plan view of a part of the spacer 20, and FIG. 2*b* is a schematic cross-sectional view of the part of the spacer 20 viewed in an A—A direction, and FIG. 3 is a schematic perspective view of a projection of the spacer 20.

Figure 2:
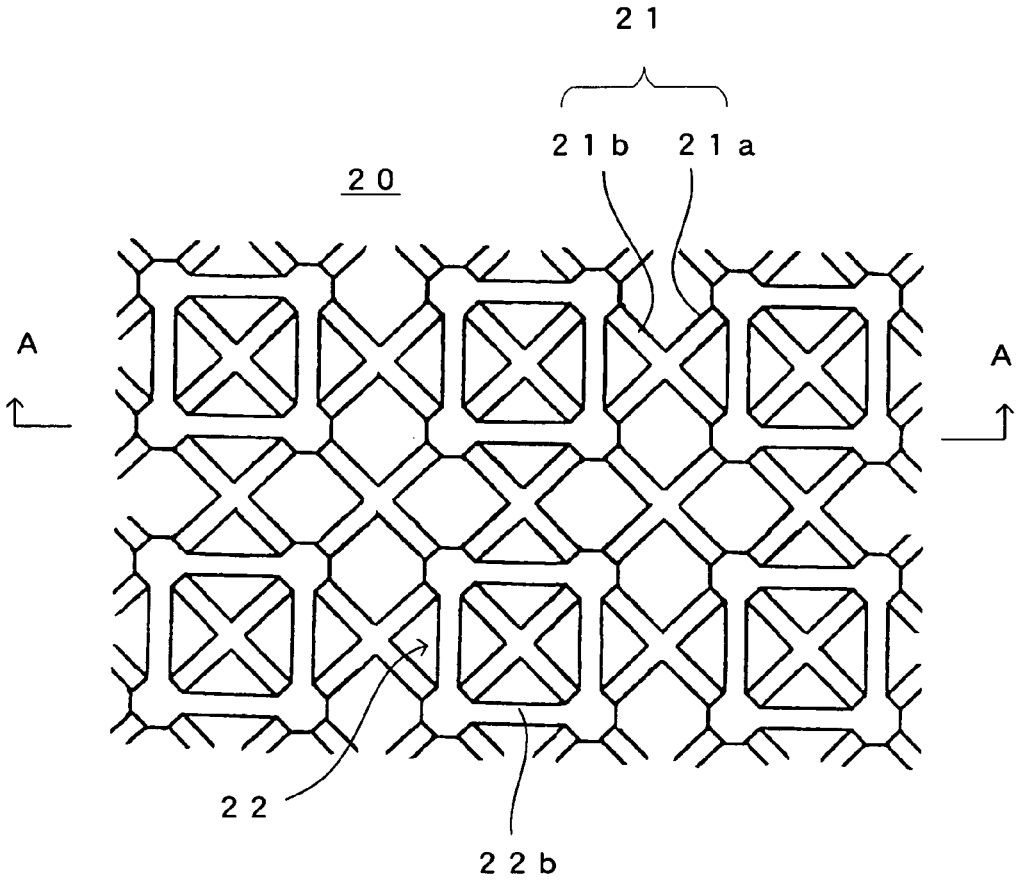
FIG. 2*a* is a schematic plan view of a part of a spacer used in the cooling suit.
FIG. 2*b* is a schematic cross-sectional view of the part of the spacer viewed in an A—A direction.
Figure 2:
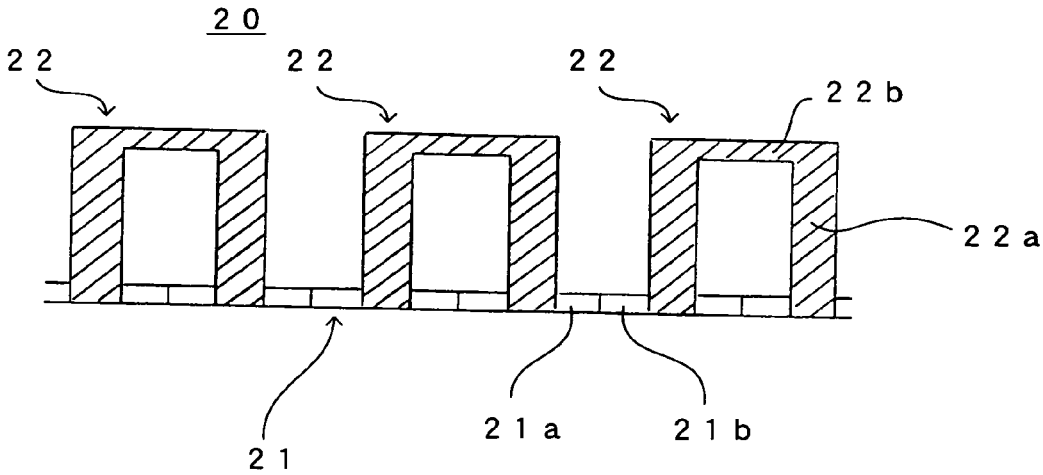
Figure 3:
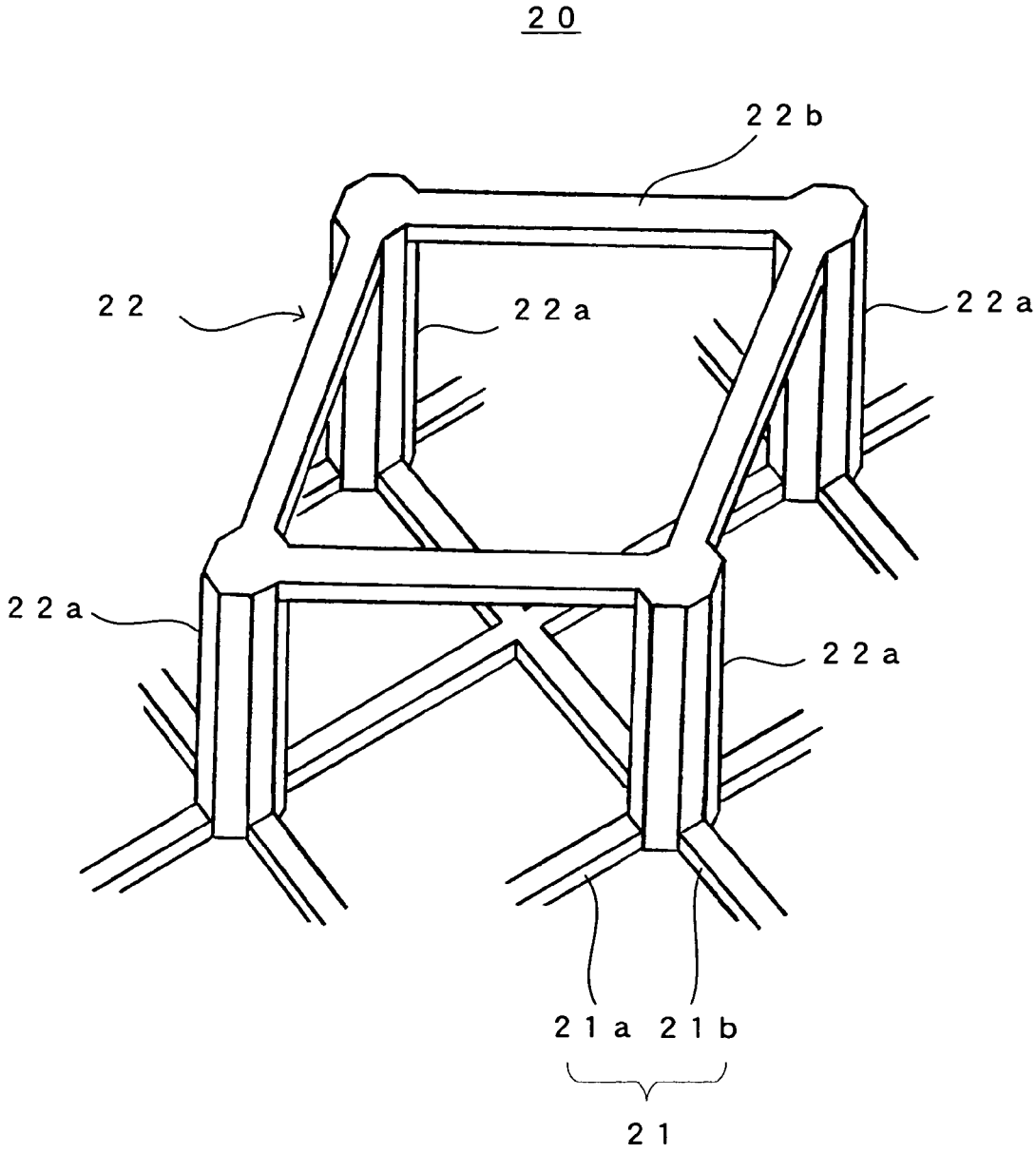
FIG. 3 is a schematic perspective view of a projection of the spacer.

The spacer 20 shown in FIG. 2 and FIG. 3 comprises a mesh member 21 and a plurality of projections 22. The mesh member 21 is formed into a substantially flat shape, and includes a plurality of first rails 21*a* and a plurality of second rails 21*b*. In FIG. 2*a*, the plurality of first rails 21*a* are arranged at regular intervals in a state counterclockwise inclined by 45 degrees relative to the lateral direction, while the second rails 21*b* are arranged at regular intervals in a state clockwise inclined by 45 degrees relative to the lateral direction. The arranging intervals of the first rails 21*a* are the same as those of the second rails 21*b*, so that each mesh of the mesh member 21 is substantially square. Here, the arranging interval of first rails 21*a* and second rails 21*b* is about 7 mm, for example.

As shown in FIG. 3, each projection 22 comprises four pillar members 22*a* and a square frame-shaped connecting member 22*b*. Each pillar member 22*a* has a length component in the thickness direction of the mesh member 21, and is physically joined to the mesh member 21 at one of four intersections which are adjacent to a predetermined intersection of those where the first rails 21*a* and second rails 21*b* are intersected. Particularly in this embodiment, each pillar member 22*a* is drawn out from the mesh member 21 perpendicularly and outwardly therefrom, i.e., vertically and upwardly in FIG. 3. For example, each pillar member 22*a* has a length of about 6 mm and a thickness of about 1.5 mm. Each frame-shaped connecting member 22*b* is formed into a frame shape connecting those ends of associated four pillar members 22*a*. Thus, each projection 22 exhibits a substantially square shape when viewed from the above as shown in FIG. 2*a*.

Further, as shown in FIG. 2*a*, the projections 22 are regularly arranged at regular intervals along the vertical direction and lateral direction. In this embodiment, the interval between adjacent two projections 22 is set at the length of one side of the frame-shaped connecting member 22*b*. This provides spaces free of projections 22 along the vertical direction (lateral direction) between those adjacent projections 22 arranged along the lateral direction (vertical direction). These spaces serve as sewing spaces for sewing spacers 20 to the cloth part 10.

The spacer 20 is monolithically formed such that the projections 22 are physically and continuously connected to one another via mesh member 21. This is because, separately providing projections 22 impractically requires time and cost for manufacturing the spacer 20. Only, it is unnecessary for the whole of the spacer 20 to be monolithic in usage. Namely, it is desirable to divide a large-sized monolithic spacer 20 into a plurality of pieces such as in view of the structure of the clothes having fasteners and in view of positions for forming airflow passages, to thereby sew the pieces of spacers 20 into the respective predetermined positions. Indeed, the spacers 20 are sewn to those positions of the cloth part 10 which correspond to the left thorax, right thorax and back, respectively, in the embodiment of FIG. 1. It is further possible to divide the spacer 20 into smaller pieces so as to fit the cooling suit to the wearer's body.

Note, since all segments of the first rails 21*a*, second rails 21*b* and frame-shaped connecting member 22*b* are shaft-like members, the spacer 20 to be used in this embodiment can be regarded as being three-dimensionally constituted such that the adopted plurality of shaft-like members are physically connected one another.

Concretely, the spacer 20 can be more readily manufactured such as by injection molding of soft plastics. Namely, the spacer 20 is shaped by pressing heated and fluidized plastics into a mold. The reason why the spacer 20 can be monolithically shaped by a mold is that the spacer 20 have no portions overlapped with other portions via spaces insofar as along the thickness direction of the spacer 20, as understood from the above structure of the spacer 20.

Adopting soft plastics as the material of the spacer 20 provides an advantage that the material cost is reduced and the strength is readily adjusted. Among plastics, it is particularly desirable to adopt polyethylene. Polyethylene is most inexpensive and has lesser adverse effects to the environment such as upon incineration. Further, it is desirable to apply an antibacterial treatment to the spacer 20. This is because the cooling suit of this embodiment may be worn such as by directly contacting the spacer with a naked skin or with a wet undergarment. In this embodiment, those garments to be worn inside or under the cooling suit shall be called an "undergarment" herein. For example, in wearing a dress shirt under the cooling suit, the dress shirt is an "undergarment" defined herein.

Relatedly, there has been conventionally provided a three-dimensionally woven cloth as a spacer for flowing air therethrough. However, such a woven cloth is more expensive than the spacer of the embodiment of the present invention, and has a larger resistance against the air flowing therethrough. Moreover, since the three-dimensionally woven cloth absorbs perspiration, it should be frequently washed. Thus, such a three-dimensionally woven cloth is inappropriate as the spacer of this embodiment.

There will be described hereinafter a sewing method of the spacer 20. Firstly, the spacer 20 is arranged at a predetermined position of the cloth part 10 such that the mesh member 21 is faced to the reverse side of the cloth part 10. Then, the spacer 20 is sewn onto the cloth part 10 such as by a sewing machine, such that the threads are wrapped around those intersections of the mesh member 21 which are positioned at the aforementioned sewing spaces of the spacer 20, respectively. This sewing operation is conducted for every sewing space formed along the vertical direction and lateral direction. The spacer 20 has the sewing spaces to thereby facilitate the sewing operation of the spacer 20.

Sewing the spacer 20 onto the cloth part 10 in this way prevents the spacer 20 from being easily stripped off even upon washing the cooling suit. Particularly, there is prolonged the service life of the cooling suit, as compared with a situation where the spacer 20 is adhered to the cloth part 10 by adhesive.

Generally, the required number of washing operations for the cooling suit depends on the shape and the wearing way of the cooling suit. For example, the number of washing operations of a sleeved cooling suit is greater than that of a sleeveless cooling suit. This is because the sleeves, if any, necessarily contact with the wearer's body so that the sleeves are stained such as by perspiration. To reduce the number of washing operations, it is conceivable to wear, under a cooling suit, an undergarment having such a shape for preventing the cooling suit from directly contacting the wearer's body, for example.

The cooling suit having such a spacer 20 is worn onto a naked skin or onto an undergarment, such that the portion of the spacer, which is reverse to the portion of the spacer 20 contacting with the cloth part 10, directly contacts with the naked skin or the undergarment. As such, wider intervals among projections 22 themselves of the spacer 20 result in rugged feeling due to projections 22 when the cooling suit is worn by a wearer. To restrict such rugged feeling, it is necessary to limit the maximum value of the intervals among the projections 22. Concretely, it is desirable to set the intervals among the projections 22 at 30 mm at the maximum.

Further, to restrict the rugged feeling to thereby improve the wearing feeling, or to exhibit high quality feeling, it is possible to provide a lining cloth on the frame-shaped connecting members 22*b*. As such a lining cloth, it is desirable to adopt a coarsely meshed material having a thickness of 3 mm or less. Such a meshed lining cloth is sewn onto the circumference of the spacer, for example. In this case, the spacer is to contact with the naked skin or the undergarment, via meshed lining cloth. In addition, the lining cloth never blocks the air inflow and outflow such as at a neck portion of the cooling suit even when the neck portion is utilized as an air inlet/outlet. Further, it is possible to use a thin cloth as the lining cloth. In this case, it is necessary to pay attention such that the lining cloth never blocks the air inflow and outflow such as at a neck portion of the cooling suit even when the neck portion is utilized as an air inlet/outlet. Adopting the lining cloth made of such a cloth causes a larger possibility that the lining cloth is permeated with perspiration. Thus, it is desirable to constitute the lining cloth in a detachable manner, so as to separately wash the lining cloth only. The lining cloth may be applied with an antibacterial treatment. Further, the lining cloth is not to form airflow passages but to absolutely improve the wearing feeling. Thus, it is not absolutely necessary to provide the lining cloth at the circumference of the spacer so as to cover the whole surface of the spacer, and it is possible to provide the lining cloth at the circumference of the spacer so as to cover only a part of the spacer.

The spacer 20 of this embodiment has its objects to fix the spacing between the cloth part 10 of the cooling suit and the wearer's body (or undergarment), and to cause the air to flow within the spacer 20. To improve the air ventilation ability, it is necessary to increase the opening ratio of the spacer 20 in the plane perpendicular to the air flowing direction. Concretely, such an opening ratio is desirably 30% or more. Meanwhile, to cause air to sufficiently contact with the surface of the wearer's body (or of the undergarment) contacting with the spacer 20, it is also necessary to increase the opening ratio of the spacer 20 at the side thereof contacting with the wearer's body (or undergarment). Concretely, such an opening ratio is desirably 20% or more. The spacer 20 of this embodiment is designed to satisfy such conditions so that the spacer 20 is capable of improving the ventilation ability and reducing the contacting surface area of the wearer's body (or undergarment) with the spacer 20. Thus, the spacer 20 has a lower heat conductivity and a superior heat insulating ability. The spacer 20 also has an advantage of an extremely light weight and a higher flexibility.

Meantime, there will be described hereinafter the reason why each fan 50 of this embodiment is provided at the lower side of the cooling suit. Wearing the cooling suit necessarily causes a gap such as at the neck portion or at the shoulder-to-axilla portion of the cooling suit. If each fan 50 is provided at the upper side of the cooling suit and the associated air inlet 30 is provided at the lower side of the cooling suit, the amount of air entering the cooling suit such as from the neck portion becomes more than the amount of air entering the air inlet 30. This results in a less amount of air flowing within the spacer 20, to thereby fail to sufficiently obtain a cooling effect to be described later. Thus, each fan 50 is provided at the lower side of the cooling suit of this embodiment, to thereby ensure a sufficient amount of air flowing within the spacer 20. Particularly, it is desirable to tighten the bottom of the cooling suit such as by a belt or to bring the bottom into the trousers. In this situation, it is necessary to set, the length from the shoulder portion down to the bottom of the cloth part, at such a value for allowing the bottom portion of the cloth part to be brought into the trousers. This allows to prevent the air flowing within the spacer 20 from leaking through the lower portion of the cooling suit.

As a countermeasure for avoiding the air leakage from the lower portion of the cooling suit, other ways are conceivable. For example, it is possible to provide a string-like member (such as a piece of string, or a string of rubber) at the bottom portion of the cooling suit, and such as to bind the ends of the string-like member or fix the ends such as by metal fixtures after wearing the cooling suit, to thereby cause the bottom portion of the cooling suit to closely contact around the waist of the wearer. FIG. 9 shows an embodiment of a cooling suit provided with such a string-like member. This embodiment adopts a string of rubber as the string-like member. The string of rubber is provided within the bottom portion of the cooling suit and fixed by a metal fixture 220. In this way, it becomes possible to prevent air from coming into and out of the lower portion of the cooling suit, even without bringing the bottom portion of the cooling suit into the trousers. Further, while the wearer is taking exercise or working, the bottom of the cooling suit may be gradually lifted up, to thereby deteriorate the close contact of the cooling suit with the wearer's body. As a countermeasure against this situation, it is possible to attach members such as made of rubber at both sides of the bottom portion of the cooling suit, respectively, and to hook the tip ends of these members onto the belt of the trousers, thereby allowing to avoid the gradual lift of the bottom of the cooling suit.

Meanwhile, the cooling suit of this embodiment is provided with totally four fans including two fans at each of the front and back, thereby practically disabling the wearer still wearing the cooling suit from sitting in/on a chair. This is because, the back portion of the cooling suit is pressed by the backrest of the chair so that the air outlets for the backside fans are blocked. To allow the wearer to sit in/on a chair while wearing such a cooling suit, it is enough to attach the backside fans to the side surfaces of the cooling suit and to insert a pad into the back portion of the cooling suit. Here, the pad is inserted to ensure the gap at the back portion of the cooling suit between the wearer's body and the cooling suit.

The reason why the mesh member is adopted as the spacer in this embodiment, is to improve the lightness and flexibility of the spacer and to facilitate the sewing of the spacer onto the cloth part, as described above. Thus, it is not absolutely necessary to form the bottom of the spacer into a meshed shape, in case of fabricating a spacer by a readily sewable material having a higher flexibility.

Figure 4:
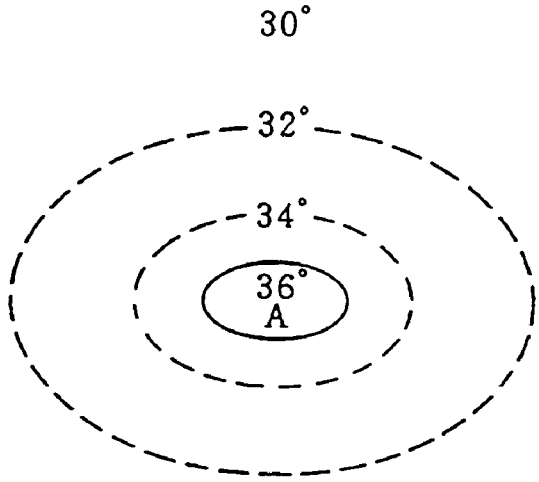
FIG. 4 is a view explaining a first cooling effect utilized in the cooling suit of this embodiment.
Figure 4:
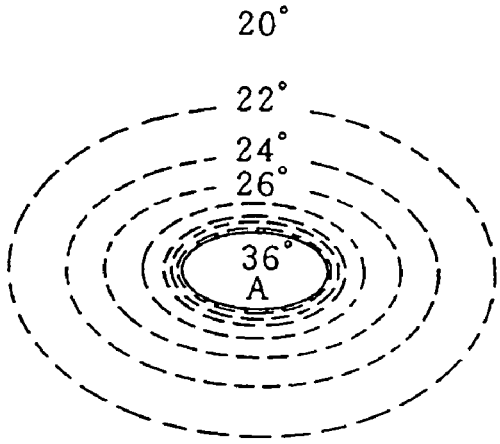
Figure 4:
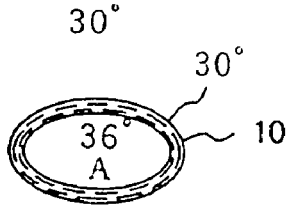

There will be described hereinafter the cooling principle to be utilized in the cooling suit of this embodiment. FIG. 4 is a view explaining a cooling effect utilized in the cooling suit of this embodiment. Schematically shown by isotherm lines (dotted lines) in FIG. 4*a* is a temperature distribution around a wearer when the wearer is in a room at the original temperature of 30° C. As shown in FIG. 4*a*, assuming that the body temperature of a wearer A as a homoiothermal animal is constant at 36° C. and that the air in the room is not largely convected, the temperature is the highest near the wearer A and is gradually lowered down to 30° C. in the direction from the wearer A.

Schematically shown by isotherm lines in FIG. 4*b* is a temperature distribution around a wearer when the wearer is in a room at the original temperature of 20° C. As understood by comparing FIG. 4*b* with FIG. 4*a*, the intervals among isotherm lines in FIG. 4*b* are denser than those in FIG. 4*a*. In other words, the temperature gradient in FIG. 4*b* is steeper than that in FIG. 4*a*. The magnitude of temperature gradient determines the heat amount to be dissipated from the wearer, and largely affects the temperature feeling of the wearer. Namely, the steeper the temperature gradient, the more strongly the wearer feels hotness and coldness.

In view of this fact, the temperature gradient just near the wearer is forcibly increased in this embodiment, thereby rendering the wearer to feel coolness and comfortableness. FIG. 4*c* shows a temperature distribution where the wearer A is wearing the cooling suit of this embodiment in a room at the original temperature of 30° C. Although the room temperature in FIG. 4*c* is the same as that in FIG. 4*a*, the wearer A is wearing the cooling suit and the cooling suit is flowed with air at 30° C. identically with the room temperature, to thereby locate the isotherm line of 30° C. at a position only slightly separated from the body of the wearer A. This extremely increases the temperature gradient from the wearer's body surface toward the surroundings, to thereby resemble the situation of FIG. 4*b* considering the temperature gradient only between the wearer A and the cooling suit.

Meanwhile, there was conducted an experiment as follows, for testing what temperature the wearers actually feel comfortableness at. 15 testees were asked to wear undergarments and normal worksuits thereon, respectively, and to conduct simple working operations, while attaching temperature sensors to those portions between the undergarment and the worksuit: at the thorax; and at the back. Then, the temperature within the room was gradually changed, such that each testee was to announce by himself/herself the temperature where he/she felt comfortableness most. FIG. 5 shows the result of the experiment in a table format indicating that the averaged comfortable temperature was about 31.5° C. Note, the temperature sensors were located at positions relatively near to the body surfaces, respectively, so that the obtained temperatures were considerably affected by the body temperatures, respectively, thereby resulting in temperatures considerably higher than the then room temperatures.

As understood from the above, temperatures of 30° C. to 32° C. near body surfaces substantially bring comfortableness. As understood from FIG. 4*b*, such temperatures near body surfaces are achieved when the room temperature is on the order of 20° C. Upon wearing the cooling suit of this embodiment, as shown in FIG. 4*c*, the temperature gradient near the body surface is substantially the same as that in FIG. 4*b* even when the room temperature is on the order of 30° C.

As described above, the comfortableness of testees is mostly affected by the temperature gradient. Thus, by wearing the cooling suit of this embodiment and flowing air within the spacer 20 to thereby bring the temperature at the portion relatively near the body surface to a temperature lower than the body temperature, there can be realized a steeper temperature gradient near the body surface. This steeper temperature gradient causes the heat dissipated from the wearer's body surface: to be readily radiated to the cooling suit side of the lower temperature; and to be quickly absorbed by the air flowing within the spacer 20. Thus, only flowing air within the spacer 20 in the cooling suit of this embodiment by fans 50 allows a wearer to feel coolness.

Meanwhile, the air flowing within the spacer 20 is warmed by the body temperature of the wearer during the flowing process, and the temperature of the air is gradually elevated. Elevation of the air temperature reduces the temperature gradient near the body surface, thereby reducing the cooling effect. However, by increasing the airflow amount to thereby flow the air through the whole of the spacer and to discharge the air before the air is warmed, the elevated amount of the air temperature is less and the cooling effect can be expected. Utilizing the above, varying the revolution number of each fan 50 allows to control the cooling effect. Concretely, it is enough to provide a temperature sensor for detecting the temperature near the associated air outlet, and controlling means (CPU) for controlling the revolution number of the associated fan based on the temperature detected by the temperature sensor.

As described above, the steeper temperature gradient near the body surface leads to a larger cooling effect. The same thing can be said about humidity. Namely, the humidity is about 100% near the body surface, in a hot condition. At this time, when a layer having the humidity of the outer atmosphere is formed near the body surface, it becomes possible to realize a steeper humidity gradient near the body surface. Such a steeper humidity gradient promotes evaporation of perspiration to thereby allow a wearer to feel coolness. Note, it is possible to provide, together with the temperature sensor, a humidity sensor for detecting the humidity near the air outlet, such that the controlling means controls the revolution number based on the temperature detected by the temperature sensor and the humidity detected by the humidity sensor.

The cooling suit of this embodiment adopts a high density cotton cloth as the cloth part 10, and forms a space at the reverse side of the cloth part 10 by the spacer 20 to flow air through this space. In a situation where the wearer has perspired but the perspiration has not been so absorbed into the undergarment, the perspiration permeates through the undergarment into the space between the cloth part 10 and the undergarment, because the undergarment allows water vapor to permeate therethrough. This moisture content is readily carried to the exterior by the air flowing within the spacer 20, to thereby promote the perspiratory effect of the wearer, thereby directly cooling the wearer's body by the absorption of an evaporation heat from the body by the perspiratory effect. Namely, by contacting the perspiration from the wearer's body with the air flowing within the spacer, the perspiration from the wearer's body is evaporated, to thereby utilize an effect to take away an evaporation heat from the surroundings upon evaporation, thereby cooling the wearer's body.

Further, in a situation where the wearer has perspired so much and most of the perspiration has been absorbed by the undergarment, the perspiration absorbed by the undergarment is carried to the exterior by the air flowing within the spacer 20, thereby extremely increasing the evaporation amount of the perspiration. This drastically lowers the surface temperature of the undergarment. For example, when the room temperature is 30° C. and the air at the same temperature as the room temperature is sufficiently flowed near the wet undergarment surface, the surface temperature of the undergarment is brought to a value lower than the room temperature by 3° C. to 5° C. Particularly, when the undergarment is closely contacted with the wearer's body, there exists a moisture content between the wearer's body and undergarment, and the heat resistance of a wet undergarment is extremely small as compared with the heat resistance of a dried undergarment, thereby causing a large temperature difference near the body surface so that the wearer feels coolness. Thus, based on the body-temperature automatic adjusting function to be inherently possessed by human beings, the wearer perspires less and is allowed to feel sufficient coolness.

As described above, the cooling suit is capable of increasing the temperature gradient as well as the humidity gradient near the body surface, thereby allowing the wearer to feel more coolness and comfortableness. This is also true when the cooling suit is directly worn on a naked skin without wearing any undergarments.

Note, when it is obliged to work in a short time under bad conditions, it is possible to supply an air such as cooled by dry ice into the airflow passages. This increases the temperature gradient and humidity gradient, to thereby allow to obtain a sufficient cooling effect.

Meanwhile, particularly when the wearer wears an undergarment under the cooling suit, it is necessary to cause the undergarment to closely contact with the wearer's body, in order to sufficiently cool the wearer's body by the absorption of an evaporation heat by the perspiratory effect. For example, spaces on the order of 5 mm between the perspiration-wetted undergarment and the body surface allow to obtain the cooling effect by a steeper temperature gradient, but reduce the cooling effect by the absorption of an evaporation heat. This is because, the heat conductivity of air is low, and the evaporation heat is not directly conducted to the wearer's body. For example, there is inevitably caused a space between the undergarment and the wearer's body, at a concave portion of the wearer's back. Indeed, the concave portion at the back of the wearer is a perspiratory position and is highly required to be cooled. Thus, such as in a situation where the cooling suit of the this embodiment is worn on an undergarment and its wearer is perspiring so much, it is an important point as to how the undergarment is closely contacted with the wearer's body so as to obtain a sufficient cooling effect.

Note, insofar as the undergarment is closely contacted with the wearer's body, it is not a serious problem whether there exists some larger space between the undergarment and cooling suit. Although the air flowing within the spacer 20 may be wasted due to the larger space, the wearer is still allowed to feel coolness.

For example, there have been conventionally sold undergarments made of a material having a larger elasticity. Wearing such undergarments is considered to render the undergarments to completely closely contact with the wearer's body. However, even when such undergarments are worn, it is difficult to closely contact the undergarments with concave portions of the wearer's body. As such, it is required to devise a way to closely contact undergarments with a wearer's body.

Several methods are conceivable, for closely contacting an undergarment with a wearer's body. Such as shown in FIG. 9*c*, the first method is to provide adjusters (adjusting means) 230 at that portion of the cloth part 10 which corresponds to the wearer's flank. The wearer is allowed to adjust the length of the cooling suit around the waist by the adjusters 230, to thereby closely contact the undergarment with the body. In the embodiment of FIG. 9*c*, left ends of the adjusters 230 are fixed to predetermined positions of the cloth part 10, respectively, by magic tapes 240, thereby adjusting the length of the cooling suit around the waist. Only, the improvement of close contact with the undergarment shall be conducted without tightening the cooling suit onto the wearer's body so strongly. Excessive tightening deteriorates the wearing feeling, and may hinder working operations. Particularly, as the adjuster 230, it is desirable to adopt a stretchable one which is partly or wholly made of rubber. Such as in breathing, the length around the waist of a wearer varies slightly. Adopting the adjuster partly or wholly made of rubber allows to finely adjust the due length of the cooling suit correspondingly to the change of the length around the waist, to thereby keep the wearer from feeling pressures around the waist.

Note, by using a material having elasticity such as spandex as the cloth part 10, it becomes possible to closely contact an undergarment with a wearer's body without any adjusters, because the cooling suit itself naturally fits onto the wearer's body. In this case, it is desirable to adopt a lot of small sized spacers without using larger sizes. This is because, larger spacers hinder the elasticity of the cloth part 10. Meanwhile, it is possible to adopt a material having elasticity such as spandex only at those side portions of the cloth part 10 which are free of spacers. Namely, such a material having elasticity is used instead of adjusters, in this case.

The second method for closely contacting an undergarment with a wearer's body, is to wear a special-purpose jacket on the cooling suit. Such a special-purpose jacket is arranged with an elastic member (urging means) such as sponge at a position corresponding to a predetermined position of the reverse side of the jacket, concretely, corresponding to the concave portion (such as the wearer's back). Wearing the special-purpose jacket causes the cooling suit to be pushed by a weak force such as by the sponge, to thereby closely contact the undergarment with the wearer's body. Further, it is desirable to fabricate the portion of the special-purpose jacket corresponding to each fan 50 such as by a mesh material, so as not to block the airflow to be discharged from the fan 50 toward the exterior. Note, the elastic member such as sponge may be provided at the cooling suit, instead of provided at the special-purpose jacket. In FIG. 9, there is provided a sponge 250 as the elastic member at a position on the surface of the cooling suit and corresponding to the concave portion (wearer's back here) of the wearer's body. In this case, there is formed a pocket 260 by a cloth at a position of the cloth part 10 corresponding to the wearer's back, and the sponge 250 is placed in the pocket 260. Here, the upper side of the pocket 260 is opened, thereby allowing to insert and draw out the sponge 250 into and from the opening. Such a sponge may be detachably attached to the cloth part by a magic tape. Further, the sponge may be inserted between the cloth part and the spacer.

The aforementioned special-purpose jacket may be a suit, uniform or vest, or worksuit, uniform. For example, security guards have to wear prescribed uniforms. Further, wearers such as attending to welding operations are required to wear fire-resistant worksuits, for example, from a standpoint of safety. In such cases, the special-purpose jacket is provided such as by attaching a sponge to the uniforms or worksuits. Note, it is desirable to constitute the sponge or the like in a detachable manner.

It is most desirable to adopt both of the first method and the second method, in order to improve the close contact of the undergarment. This allows to closely contact the cooling suit with the wearer's body, together with the undergarment. In such a case, it is not absolutely necessary to wear an undergarment made of a material having a higher elasticity, and normal undergarments or T-shirts will do.

Moreover, as a third method for closely contacting an undergarment with a wearer's body, it is conceivable to provide: a pocket at a predetermined position of the surface of the cloth part 10 such as at a position corresponding to the concave portion of the wearer's back; and an adjuster on the surface of the pocket. In this case, by inserting an elastic member such as sponge into the pocket and then tightening the pocket by the adjuster, that portion of the undergarment which corresponds to the concave portion of the wearer's back is pushed by the sponge and closely contacted with the wearer's body.

In the cooling suit of this embodiment, there is provided the spacer for ensuring the airflow passage between the cloth part and the wearer's body such that an airflow is forcibly caused within the airflow passage by the fan, thereby allowing to flow the air substantially parallelly to the body surface between the cloth part and the wearer's body, so as to increase the temperature gradient near the body surface. Thus, simply wearing such a cooling suit enables the wearer to feel coolness and comfortableness. Further, in a perspiring situation, the perspiration can be carried out by the air flowing within the airflow passage to thereby promote a further perspiratory effect, so as to directly cool the wearer's body by the absorption of an evaporation heat by the perspiratory effect, thereby resulting in a further improved cooling effect.

Moreover, the cooling suit of this embodiment is worn on a naked skin or undergarment, such that the spacer directly contacts with the naked skin or undergarment at that side of the spacer which side is opposite to the side contacting with the cloth part. Namely, one side of the spacer contacts with the cloth part, but the opposite side is in an exposed state. Relatedly, it might be conceivable to adopt a spacer of a sandwiched structure which is wholly covered by cloths except for the air inlets and air outlets. To fabricate the cooling suit in this case, it is necessary to previously manufacture such a sandwich-structure spacer (airflow passage) as an independent part, and to later attach it to the cloth part. However, the cooling suit with a one-side exposed spacer is advantageous in many aspects as compared with the cooling suit adopting a sandwich-structure spacer.

Namely, the cooling suit with the one-side exposed spacer can be readily manufactured, as compared with the cooling suit having the sandwich-structure spacer. Further, since the cooling suit with the one-side exposed spacer has no redundant pieces of cloth at the side contacting with the wearer's body (undergarment), the cooling suit has a longer durability as well as a superior flexibility. Still more, the cooling effect is remarkable, by eliminating the heat resistance and evaporation resistance due to such redundant cloths.

Further, in the cooling suit having the sandwich-structure spacer, the cloths are apt to be permeated with perspiration upon wearing and should be frequently washed. Still more, the spacer is accumulated with water upon washing, and the cooling suit is not readily dried. Contrary, the cooling suit with the one-side exposed spacer is not so.

Moreover, in the cooling suit with the one-side exposed spacer, there is formed the airflow passage by the spacer when the cooling suit is worn by a wearer, thereby making it unnecessary to previously fabricate the airflow passage as an independent part. Thus, utilizing a spacer having a larger surface area directly enables to increase the cooling surface area. Particularly, such as in utilizing the neck portion as the air inflow and outflow opening, it is possible to readily add a spacer extended up to the neck portion. Further, it is possible to utilize a relatively large single fan, and the attaching position of the fan is not so limited. In addition, it is possible to provide a fan separately from the cooling suit, and to introduce the air from the fan into the spacer such as via duct.

Meanwhile, when the spacer of this embodiment is used to constitute the airflow passage, air may flow within the airflow passage in a possible laminar flow state under a particular condition. Namely, the air within the airflow passage flows in the laminar state without a larger random fluctuation. At this time, the partial air flowing along the wearer's body side within the airflow passage absorbs the perspiration from the wearer's body and is immediately saturated. Even if such wet air is flowed so much, the evaporation of perspiration is not promoted any more. Contrary, the partial air flowing along the cloth part side within the airflow passage absorbs substantially no perspiration and is kept in a still dried state, and is then discharged from the air outlet. Thus, in such a situation, it is impossible to effectively carry the perspiration to the exterior, thereby problematically failing to obtain a larger cooling effect. To solve such a problem, it is necessary to provide, at several points within the airflow passage, air agitating means for agitating the air flowing within the airflow passage, to thereby flow the air while causing a random flow of the air within the airflow passage. As such air agitating means, for example, it is possible to adopt projections provided at predetermined positions of the spacer to thereby partly narrow the spacing of the airflow passage.

The present invention is not limited to the above, and various modifications are possible within the spirit of the present invention.

For example, in the aforementioned embodiment, there has been described a situation where the cooling suit of the present invention is applied to a sleeveless vest as shown in FIG. 1. This is a simple example. It is possible to apply the cooling suit of the present invention to: long-sleeved garments; short-sleeved garments; trousers; and so-called "overalls" prepared by connecting jacket and trousers.

Figure 13:
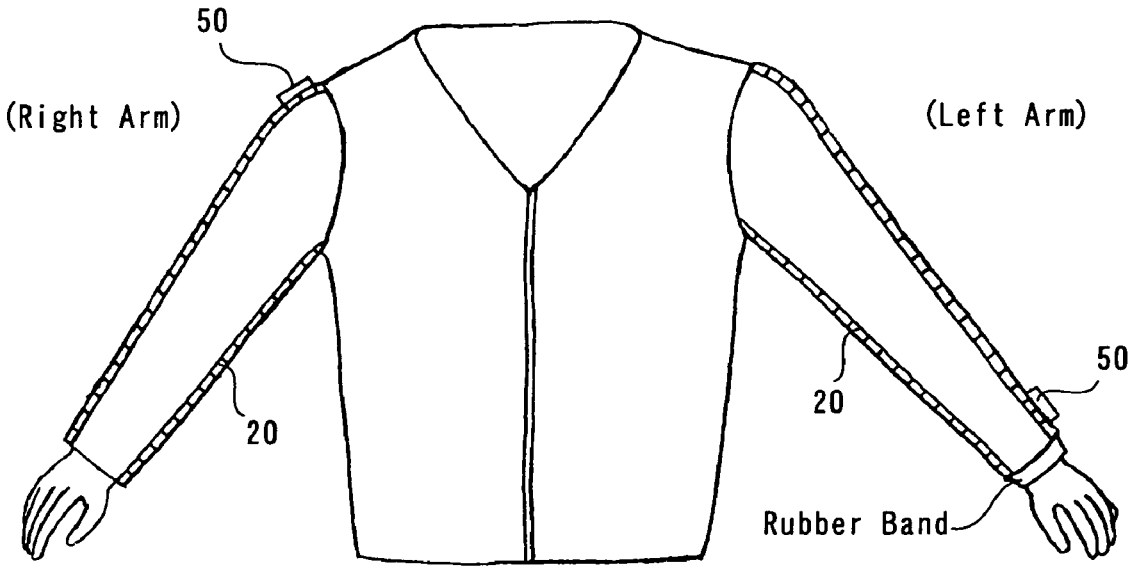
FIG. 13 is a view explaining a long-sleeved cooling suit.

FIG. 13 is a view explaining a long-sleeved cooling suit. Note, in FIG. 13, the long sleeves of the cooling suit are shown in cross sections. Further, the structure of the body portion of the cooling suit is schematically shown. To cool the arms of the wearer, it is naturally required to provide the spacer 20 over the whole of the long sleeves of the cooling suit. There are various methods to select routes for flowing air within the spacer 20. As shown at the right arm portion in FIG. 13, the first method is to provide the fan 50 at the upper arm portion or shoulder portion and to leave the cuff portion open. Namely, air is flowed into the spacer 20 via cuff, and flowed out via fan 50 after flowing through the spacer 20. At this time, it is possible to provide an air stopper at the shoulder portion of the cooling suit so as to block the airflow between the long sleeve portion and the body portion, to thereby form an independent airflow passage at the long sleeve portion. Further, as shown at the left arm portion of FIG. 13, the second method is to closely contact the cuff portion with the wrist by means of an elastic member such as a rubber band, and to provide the fan 50 near the cuff portion. In this case, air is flowed into the spacer 20 via air inlets provided at the thorax and back portions of the cooling suit, then through the spacer 20 provided at the long sleeve portion, and finally flowed out from the fan 50 near the cuff.

Here, arms are active portions for human beings. Thus, it is necessary to devise to closely contact the cooling suit with the arms even when the arms are bent, in order to improve the cooling effect at such arm portions. Generally, to closely contact those portions of the cooling suit with the wearer's body (undergarment) which correspond to bent portions such as arms and/or uneven portions such as busts, it is enough to use a stretchable material at the cloth part of the applicable portion and to sew many pieces of small size spacers onto the stretchable material. This allows the cooling suit to fit on bent portions or uneven portions of a wearer's body, for example. In this regard, since it is practically impossible to reduce the size of the aforementioned sandwich-structure spacer so small, it is difficult for the cooling suit adopting such a spacer to sufficiently cool those extremely uneven portions of the wearer's body. Contrary, the cooling suit of the present invention exhibits a sufficient cooling effect even for those extremely uneven portions of the wearer's body. If it is unnecessary to cool such bent portions and/or uneven portions, it is possible to omit a spacer at the cloth part corresponding to such portions.

Figure 14:
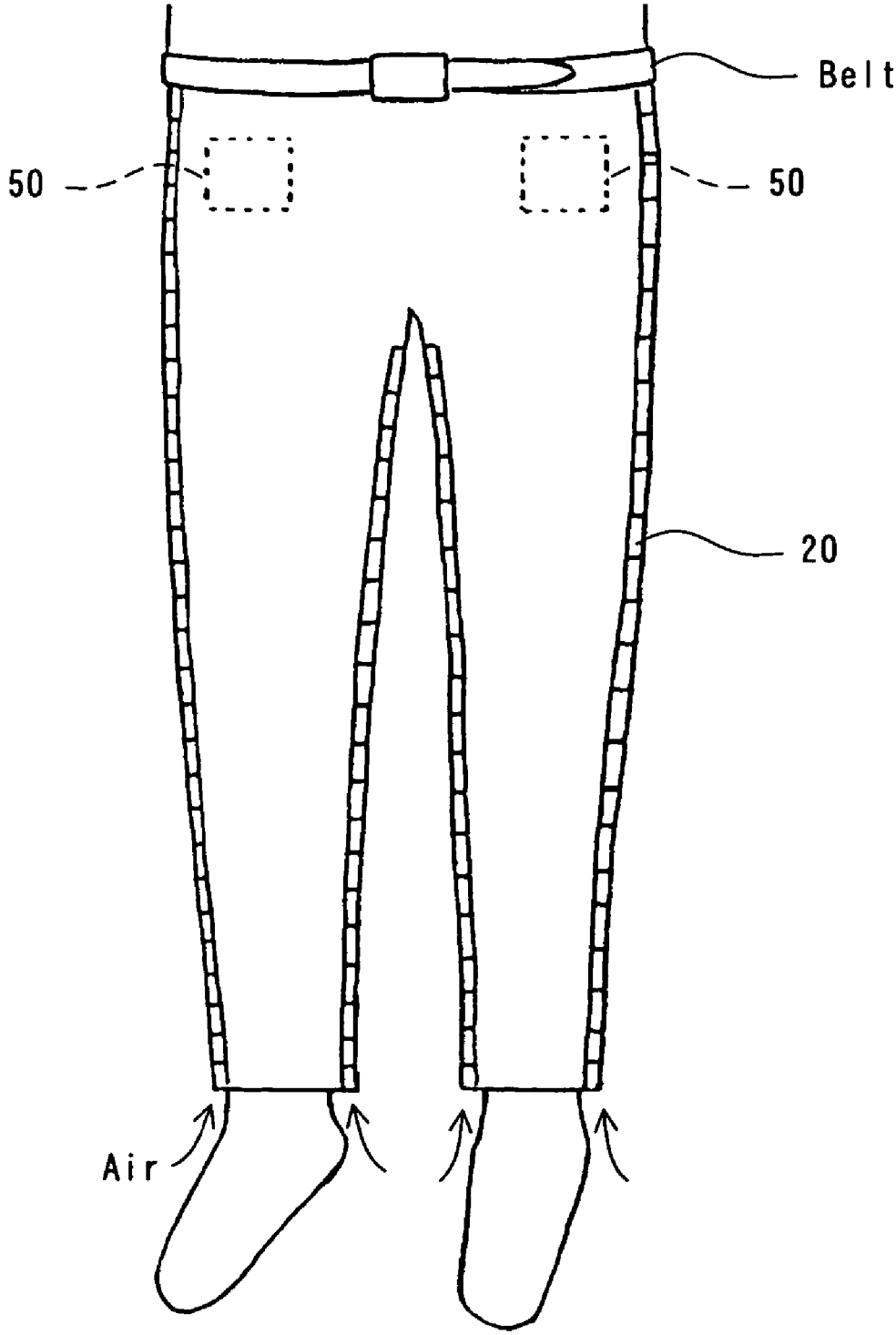
FIG. 14 is a view explaining a lower-body cooling suit.

FIG. 14 is a view explaining a lower-body cooling suit (cooling trousers). Herein, FIG. 14 shows a cross-sectional view of such trousers. To cool the lower body of the wearer, it is naturally required to provide the spacer 20 over the whole of the trousers. In such cooling trousers, the fans 50 are provided at the upper portions of the trousers, i.e., at the underbelly portion of the wearer. The bottom portions at the ankle side are opened. In the above, the wearer is to tighten up the belt at the position upper than the fans 50, upon wearing the trousers. This allows to prevent the air within the spacer from leaking via upper side of the trousers. Air is to flow into the spacer 20 from the bottom portions of the trousers, passes through the spacer 20, and is finally flowed out via fans 50.

In the above embodiments, there have been described such situations where the spacers are attached to those portions of the cloth part which correspond to the left thorax, right thorax and back of the wearer, to thereby cool the thorax and back. However, the attaching position of the spacer can be arbitrarily determined correspondingly to those positions to be cooled. For example, in case of cooling the wearer's back only, it is enough to attach the spacer to only that portion of the cloth part corresponding to the wearer's back.

Further, in the above embodiments, there have been described such situations where the air inlets and fans are provided at the upper side and lower side of the cloth part, respectively. However, it is also possible to provide the fan at the substantially center or slightly lower position of the cloth part in the vertical direction, and to provide the air inlets at both of the upper side and lower side of the cloth part. This allows the air flowed from the upper and lower air inlets to be taken out via fan after flowing through the spacer, to thereby cool a wider area of the wearer's body. Moreover, by providing the fan at the substantially center or slightly lower position of the cloth part in the vertical direction, the fan is prevented from being brought into the trousers even when the bottom portion of the cooling suit is brought into the trousers. Further, the streams of air entering the airflow passage via upper and lower air inlets, respectively, travel about half the distance within the airflow passage as compared with the situation providing the fan at the lower side, to thereby attain such a merit that the resistance to the flowing air is reduced.

In the above embodiments, it is desirable to apply a heat-ray reflecting treatment onto the surface of the cloth part, when the cooling suit is mainly used upon outdoor working operations. This allows to improve the cooling effect by the cooling suit such as in conducting working operations in blazing midsummer.

Further, in the above embodiments, there have been described those situations adopting the axial-flow fans as the fans. However, instead of the axial-flow fan, it is possible to adopt such as a sirocco fan for feeding, the air sucked in the axial direction of the vanes, radially into the outer peripheral direction of the vanes (this sirocco fan shall be called a "sideward-flow fan", in the meaning that air is flowed out via side portions of the fan).

Figure 7:
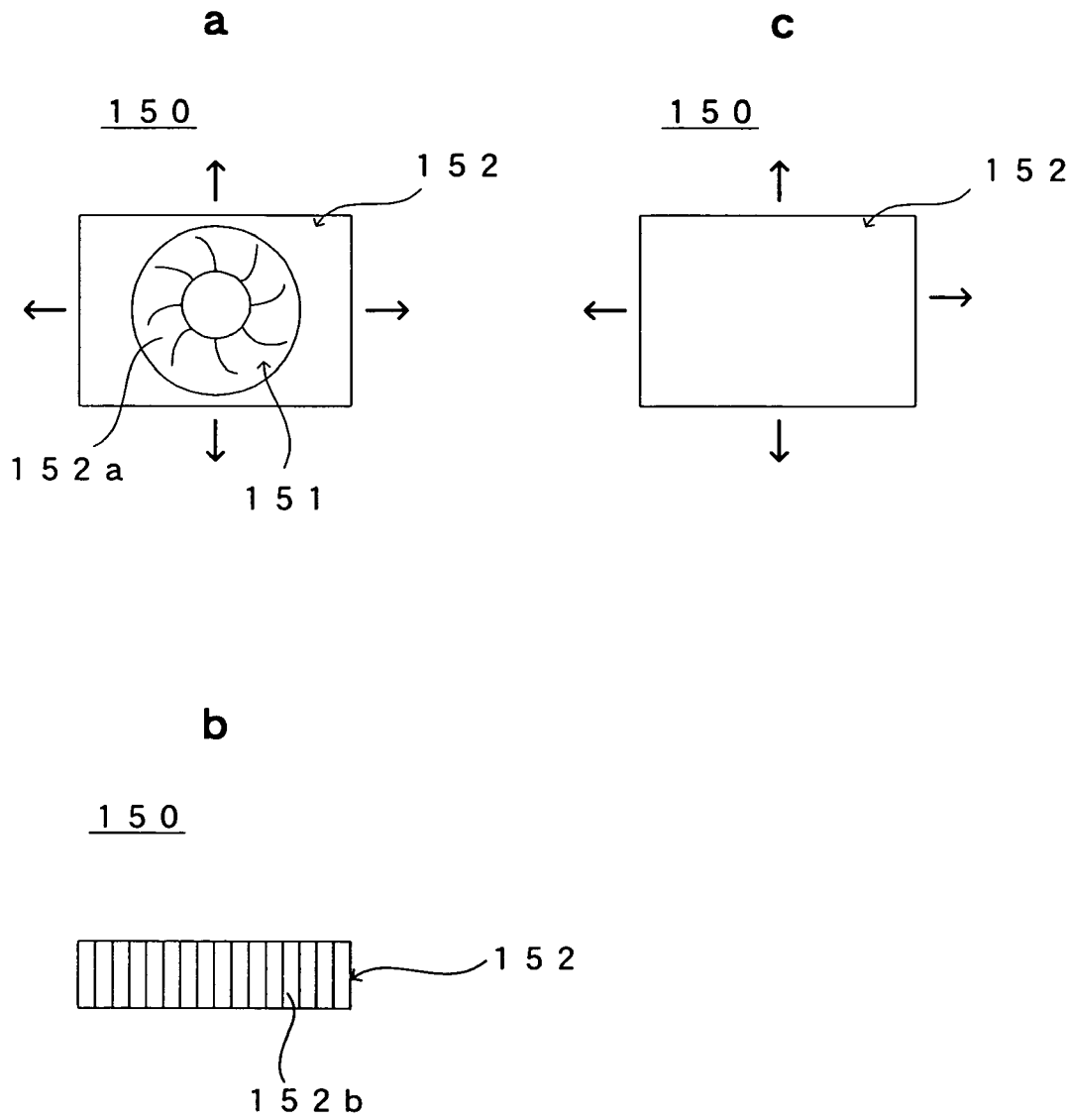
FIG. 7*a* is a schematic plan view of a sideward-flow fan.
FIG. 7*b* is a schematic side view of the sideward-flow fan.
FIG. 7*c* is a schematic rear view of the sideward-flow fan.

FIG. 7*a* is a schematic plan view of such a sideward-flow fan, FIG. 7*b* is a schematic side view of the sideward-flow fan, and FIG. 7*c* is a schematic rear view of the sideward-flow fan. This sideward-flow fan 150 includes a vane portion 151, and a frame 152 for housing the vane portion 151 therein. The frame 152 is provided at the front side thereof with a suction opening 152*a* for sucking air, and is formed at the side surfaces thereof with multiple slits 152*b* acting as air discharging openings. The frame 152 has a flat back side. As shown by arrows in FIG. 7, the air sucked in the axial direction of the vane portion 151, i.e., via suction opening 152*a* is discharged to the exterior via slits 152*b* at the side surfaces of the frame 152. Such a sideward-flow fan 150 is characterized in that the same can be thinned, as compared with an axial-flow fan. As such, sideward-flow fans are used in coolers for CPU such as in a notebook-sized personal computer.

Figure 8:
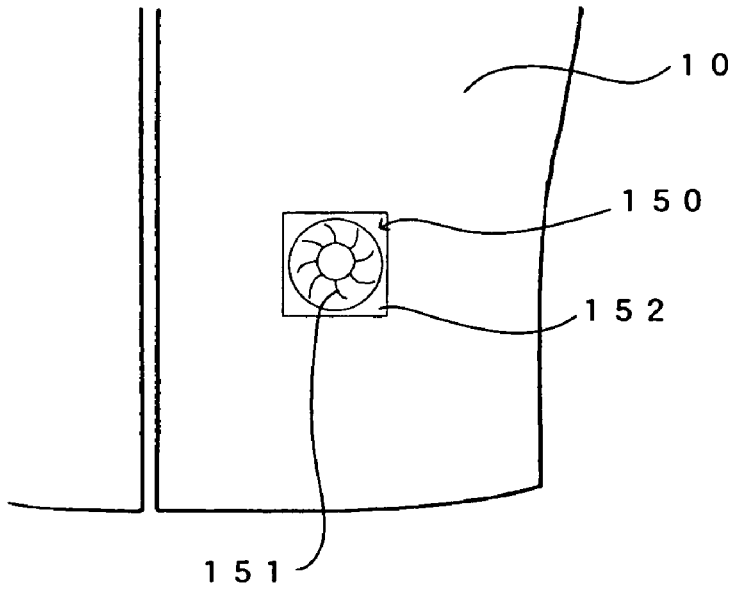
FIG. 8 is a view showing an attaching method of the sideward-flow fan.
Figure 8:
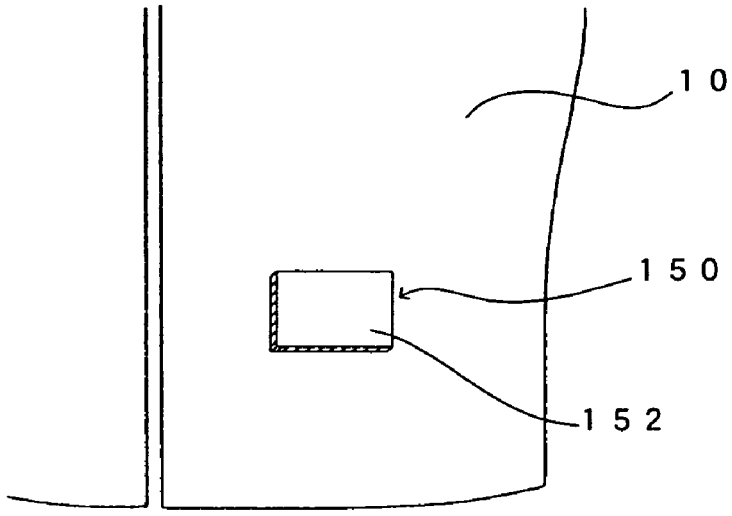

There will be described hereinafter the way to attach such a sideward-flow fan 150 to the cooling suit, in adopting the sideward-flow fan 150. There shall be considered a situation where the sideward-flow fan 150 is to be attached to the lower side of the cooling suit. As the attaching methods for the sideward-flow fan 150, there are two methods, as follows. FIG. 8 is a view showing an attaching method of the sideward-flow fan 150. As shown in FIG. 8*a*, the first attaching method is to bury the sideward-flow fan 150 into the spacer, such that the suction opening 152*a* is faced or oriented in the direction from the reverse side of the cooling suit toward the outer side or front side thereof. Here, the thickness of the used sideward-flow fan 150 is substantially the same as the spacer. In this situation, there is formed an air inlet at the position of the cloth part 10 corresponding to the portion buried with the sideward-flow fan 150, and the air outlet is to be formed at the portion upper than the air inlet. The air sucked via air inlet by the sideward-flow fan 150 is radially fed via side surfaces of the sideward-flow fan 150 within the spacer, then passed within the spacer, and finally discharged to the exterior through the air outlet. Attaching the sideward-flow fan 150 by the first method provides an advantage that no bulged portions are caused in the cooling suit due to the fan thickness.

As shown in FIG. 8*b*, the second method is to oppose the suction opening 152*a* to the surface of the cloth part 10, so as to attach the sideward-flow fan 150 to the cloth part 10 such that the sideward-flow fan 150 covers the air outlet. Namely, the back side of the frame 152 is visible, when the cooling suit is viewed from the front. In this situation, the air inlet is to be formed at the upper side of the cloth part 10 of the cooling suit and the air outlet is to be formed below the air inlet, similarly to the previously described embodiments. The air flowed through the air inlet passes within the spacer, reaches the air outlet, and is then discharged to the exterior through the side portions of the sideward-flow fan 150. Attaching the sideward-flow fan 150 by the second method provides an advantage that the vane portion 151 becomes invisible from the exterior upon wearing the cooling suit, and the vane portion 151 can be protected by the frame 152. Further, the air discharge from the sideward-flow fan 150 is never blocked by a jacket, even when the jacket is worn onto the cooling suit.

In the aforementioned embodiments, there have been described those situations for adopting such a spacer including the mesh member, the plurality of pillar members, and the plurality of connecting members. However, it is possible to adopt other various spacers. For example, it is possible to adopt a spacer comprising a plurality of substantially cylindrical sponges adhered to the cloth part at regular intervals. Here, the cylindrical sponges are drawn from the reverse side of the cloth part in the substantially perpendicular direction. To fabricate the cooling suit in this case, the cylindrical sponges are firstly adhered to the cloth part by an adhesive. Then, such a cloth is cut and sewn to thereby obtain the cooling suit. Note, adopting sponge provides a merit of being soft to the touch. Generally, it is possible to adopt plastics, for example, instead of sponge.

Figure 6:
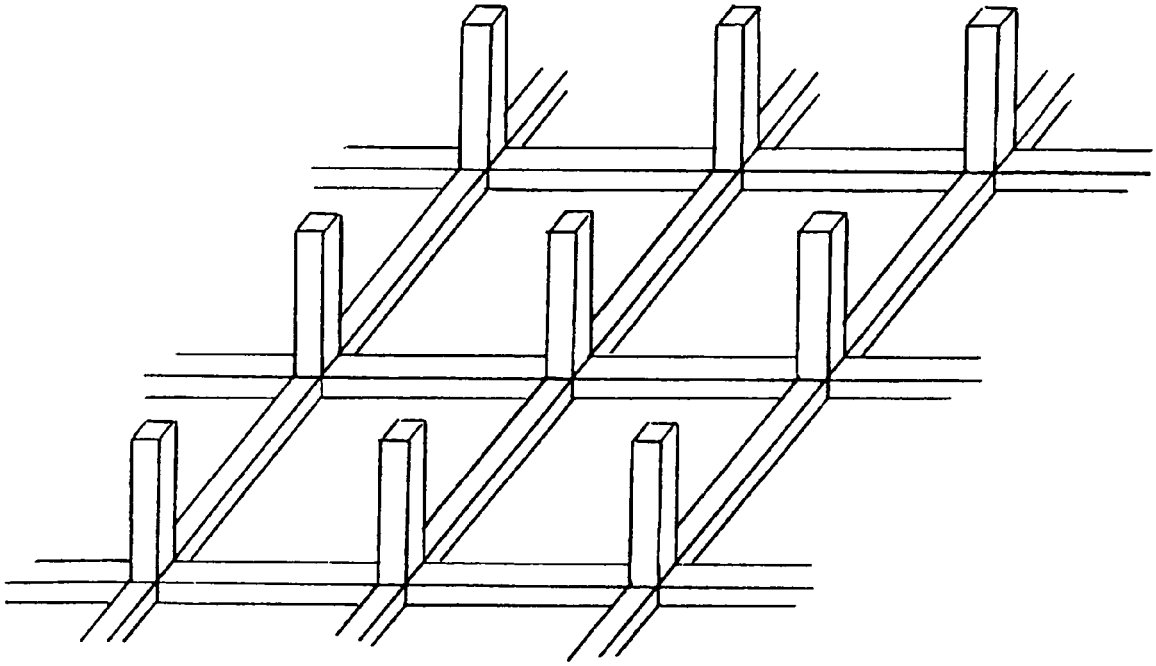
FIG. 6 is a schematic perspective view of another spacer utilized in the cooling suit of the present invention.

Further, as another example of the spacer as shown in FIG. 6, it is possible to adopt a spacer including a mesh member and a plurality of pillar members drawn out in the upward and vertical direction in the figure, from intersections of the mesh member, respectively. This spacer is different from the above embodiment, in that this spacer is provided with no connecting members and is provided with the pillar members at all the intersections of the mesh member. Note, it is not absolutely necessary to provide the pillar members at all the intersections.

Generally, it is preferable that the thickness of the spacer is 2 mm to 10 mm. Thickness of the spacer smaller than 2 mm requires to considerably increase the air pressure so as to flow a predetermined amount of air, and thus impractical. Contrary, thickness of the spacer lager than 10 mm deteriorates the appearance and wearing feeling of the cooling suit, and tends to problematically cause air to flow through the airflow passage in a laminar flow state. Further, it is desirable to adopt a non-water-absorbing spacer.

In the above embodiments, it is possible to provide a plurality of rod-like sponges at predetermined positions within the spacer so as to divide the space within the spacer, to thereby flow the air along a desired route within the airflow passage. In this case, the sponges act as flow passage guides (air guiding means). This scheme is to be used such as when it is desired to provide only one large fan at the back portion of the cooling suit, so as to substantially equally guide the air by the fan into the front and back airflow passages. Here, the sponges are attached to the spacer such as by adhering by adhesive or by sewing. It is further possible to utilize such sponges as air stoppers for blocking the air inflow and outflow. For example, air stoppers are provided at the shoulder portion of the cooling suit, when it is desired to increase the air inflow from the portion of the cooling suit around the neck.

Moreover, there have been described situations for adopting soft plastics as the spacer material in the above embodiments. However, it is possible to adopt a spacer made of rubber. Further, it is possible to detachably attach the spacer to the cloth part, instead of sewing the spacer to the cloth part. Indeed, it is possible to roughly attach the spacer to the cloth part without firmly attaching, because it is enough to only form the airflow passage between the cloth part and the wearer's body upon wearing the cooling suit. For example, it is possible to adhere the spacer to the cloth part by a magic tape or two-sided adhesive tape, or to hang the spacer onto anchors provided on the cloth part. Alternatively, it is possible to attach the spacer to the cloth part such as by hooks and buttons. This allows to readily detach the spacer upon washing the cooling suit. Meanwhile, in adopting a spacer made of plastics, plastics are apt to deteriorate when exposed to the sunlight. As such, detaching the spacer from the cooling suit upon washing the same and drying outdoors the cooling suit as it is, allows to avoid shortening the service life of the spacer. Further, rendering the spacer detachable allows to readily replace the used spacer by a new one, such as when the former is impaired. Note, in adopting the aforementioned sandwich-structure spacer, it is impossible to detachably attach it to the cloth part. The cooling suit of the present invention is superior also in this aspect.

In the cooling suit of the aforementioned embodiments, the adopted spacers have such features that the thicknesses thereof can be freely determined and the spacers are extremely lightweight and superior in flexibility. By utilizing the features of such spacers, it is even possible to fabricate a cooling suit provided with the spacer only at the reverse side of the cloth part. Namely, such a cooling suit is provided with the cloth part and spacer, for example, but does not have the fans and battery having been provided in the aforementioned embodiments. Similarly to the aforementioned embodiments, this cooling suit is also to be worn onto a naked skin or undergarment such that the spacer directly contacts with the naked skin or undergarment at that side of the spacer which side is opposite to the side contacting with the cloth part. In this case, for example, air is to flow into the airflow passage from the lower side of the cooling suit by convection due to the heat of the wearer's body, passes through the airflow passage, and is then discharged from the upper portion of the cooling suit.

As conventional garments with cool feeling, there have been provided vests having inner side adhered with meshed cloths or having inner side provided with many pieces of kite-aimed string or the like, for example. However, such vests adhered with the meshed cloths provide extremely narrow gaps between the wearer's bodies and vests, so that the airflow ability is not so excellent along the direction parallel to the body surfaces. As such, there has not been provided sufficient cool feeling. This is also true in those vests provided with pieces of kite-aimed string or the like. In this case, to sufficiently increase the gaps between the wearer's bodies and vests, it is required to use thick pieces of kite-aimed string, to thereby cause another problem of extremely heavier weights of the vests.

Contrary, the cooling suit provided with only the spacer at the inner side of the cloth part allows to sufficiently increase the gap between the cloth part and the wearer's body, to thereby ensure the airflow passage along the direction parallel to the body surface. This allows air to naturally convect within the airflow passage, so that the wearer feels coolness. Further, the extremely light weight of the spacer keeps the wearer from feeling the cooling suit to be heavy. Of course, this spacer-only cooling suit is inferior to those of the aforementioned embodiments in terms of the cooling effect. Nonetheless, this spacer-only cooling suit has a sufficient cooling effect, such as when it is used in summer as a vest for an angler or cameraman.

Note, the cooling suit provided with the spacer at the inner side of the cloth part can be applied to T-shirts, for example, without limited to vests. In such a case, such a T-shirt may be worn on an undergarment, and a jacket may be worn on the T-shirt.

INDUSTRIAL APPLICABILITY

As described above, the present invention is to flow air within the spacer provided between the cloth part and a wearer's body in a manner substantially parallel to the wearer's body surface so as to increase the temperature gradient near the wearer's body surface to thereby cool the wearer's body, and, such as in a perspiring situation, to thereby carry the perspiration to the exterior by the air flowing within the spacer thereby promoting the perspiratory effect of the wearer in order to directly cool the wearer's body by absorbing the evaporation heat by the perspiratory effect, so that the present invention can be applied to garments to thereby allow to feel comfortableness with a reduced power consumption and a simple structure.

The invention claimed is:

1. A cooling suit to be worn on an upper body of a wearer, comprising:

a cloth part;

at least one spacer provided at a predetermined position of a reverse side of said cloth part, so as to ensure an airflow passage between said cloth part and the wearer's body when said cooling suit is worn by the wearer;

an air inlet provided at said cloth part so as to introduce air from the exterior into said airflow passage;

an air outlet provided at said cloth part so as to take out the air within said airflow passage;

air-blowing means for forcibly causing an airflow within said airflow passage; and power source means for supplying an electric power to said air-blowing means;

wherein the or each spacer is constituted to comprise a plurality of shaft-like members physically connected to one another, and the or each spacer has an opening ratio of 30% or more in the plane perpendicular to the air flowing direction.

2. A cooling suit to be worn on an upper body of a wearer, comprising:

a cloth part;

at least one spacer provided at a predetermined position of a reverse side of said cloth part, so as to ensure an airflow passage between said cloth part and the wearer's body when said cooling suit is worn by the wearer;

an air inlet provided at said cloth part so as to introduce air from the exterior into said airflow passage;

an air outlet provided at said cloth part so as to take out the air within said airflow passage;

air-blowing means for forcibly causing an airflow within said airflow passage; and power source means for supplying an electric power to said air-blowing means;

wherein the or each spacer is constituted to comprise a plurality of shaft-like members physically connected to one another, and the or each spacer has an opening ratio of 30% or more in the plane perpendicular to the air flowing direction, and wherein said cooling suit is worn onto a naked skin or undergarment of the wearer such that the or each spacer directly contacts with the naked skin or undergarment at that side of the or each spacer which side is opposite to the side contacting with said cloth part.

3. A cooling suit to be worn on an upper body of a wearer, comprising:

a cloth part;

at least one spacer provided at a predetermined position of a reverse side of said cloth part, so as to ensure an airflow passage between said cloth part and the wearer's body when said cooling suit is worn by the wearer;

a lining cloth provided at that side of the or each spacer which side contacts with the wearer's body;

an air inlet provided at said cloth part so as to introduce air from the exterior into said airflow passage;

an air outlet provided at said cloth part so as to take out the air within said airflow passage;

air-blowing means for forcibly causing an airflow within said airflow passage; and power source means for supplying an electric power to said air-blowing means;

wherein the or each spacer is constituted to comprise a plurality of shaft-like members physically connected to one another, and the or each spacer has an opening ratio of 30% or more in the plane perpendicular to the air flowing direction, and wherein said cooling suit is worn onto a naked skin or undergarment of the wearer such that the or each spacer contacts, via said lining cloth, with the naked skin or undergarment at that side of the or each spacer which side is opposite to the side contacting with said cloth part.

4. A cooling suit to be worn on a lower body of a wearer, comprising:

a cloth part;

at least one spacer provided at a predetermined position of a reverse side of said cloth part, so as to ensure an airflow passage between said cloth part and the wearer's body when said cooling suit is worn by the wearer;

an air inlet provided at said cloth part so as to introduce air from the exterior into said airflow passage;

an air outlet provided at said cloth part so as to take out the air within said airflow passage;

air-blowing means for forcibly causing an airflow within said airflow passage; and power source means for supplying an electric power to said air-blowing means;

wherein the or each spacer is constituted to comprise a plurality of shaft-like members physically connected to one another, and the or each spacer has an opening ratio of 30% or more in the plane perpendicular to the air flowing direction.

5. A cooling suit to be unitedly worn on a wearer's body including an upper body and a lower body, comprising:

a cloth part;

at least one spacer provided at a predetermined position of a reverse side of said cloth part, so as to ensure an airflow passage between said cloth part and the wearer's body when said cooling suit is worn by the wearer;

an air inlet provided at said cloth part so as to introduce air from the exterior into said airflow passage;

an air outlet provided at said cloth part so as to take out the air within said airflow passage;

air-blowing means for forcibly causing an airflow within said airflow passage; and power source means for supplying an electric power to said air-blowing means;

wherein the or each spacer is constituted to comprise a plurality of shaft-like members physically connected to one another, and the or each spacer has an opening ratio of 30% or more in the plane perpendicular to the air flowing direction.

6. A cooling suit of anyone of claims 1 through 5, wherein said cooling suit renders perspiration from the wearer's body to contact with the air flowing within the or each spacer so as to evaporate the perspiration from the wearer's body, to thereby utilize an effect to take away an evaporation heat from the surroundings upon the evaporation, thereby cooling the wearer's body.

7. A cooling suit of anyone of claims 1 through 5, wherein said air-blowing means feeds, the air sucked in the axial direction of vanes, radially into the outer peripheral direction of the vanes.

8. A cooling suit of anyone of claims 1 through 5, wherein said air-blowing means is detachably attached to said cloth part via holding means for holding said air-blowing means.

9. A cooling suit of claim 8, wherein said holding means clamps said air-blowing means by a plurality of elastic members.

10. A cooling suit of claim 8, wherein said holding means includes an electrode portion connected to said power source means, so that said air-blowing means is supplied with an electric power via said electrode portion when said air-blowing means is held by said holding means.

11. A cooling suit of claim 10, wherein said air-blowing means includes a frame provided with an electrode portion connected to driving means of the vanes, so that said electrode portion of said air-blowing means is contacted with said electrode portion of said holding means when said air-blowing means is held by said holding means.

12. A cooling suit of anyone of claims 1 through 5, wherein the or each spacer has an opening ratio of 20% or more at the side of the or each spacer which contacts with the wearer's body.

13. A cooling suit of anyone of claims 1 through 5, wherein the or each spacer is sewn to said reverse side of said cloth part.

14. A cooling suit of claim 13, wherein the or each spacer comprises:

a mesh member formed into a substantially flat shape, and a plurality of pillar members, each pillar member having a length component in the thickness direction of said mesh member and each pillar member being physically joined to said mesh member at a predetermined position of said mesh member; and wherein said mesh member is arranged to oppose to said reverse side of said cloth part so that the or each spacer is sewn to said cloth part making use of said mesh member.

15. A cooling suit of anyone of claims 1 through 5, wherein the or each spacer is detachably provided on said reverse side of said cloth part.

16. A cooling suit of anyone of claims 1 through 5, wherein the or each spacer comprises:

a mesh member formed into a substantially flat shape;

a plurality of pillar members, each pillar member having a length component in the thickness direction of said mesh member and each pillar member being physically joined to said mesh member at a predetermined intersection of said mesh member; and a plurality of connecting members each formed into a frame shape connecting those ends of the associated pillar members.

17. A cooling suit of anyone of claims 1 through 5, wherein the or each spacer is made of plastics or rubber.

18. A cooling suit of anyone of claims 1 through 5, wherein the or each spacer is non-water-absorbing.

19. A cooling suit of anyone of claims 1 through 5, wherein the or each spacer is applied with an antibacterial treatment.

20. A cooling suit of anyone of claims 1 through 5, wherein the or each spacer is thickened at the circumference around the position for attaching said air-blowing means to the or each spacer, so as to bury the air-blowing means into the or each spacer.

21. A cooling suit of anyone of claims 1 through 5, wherein said cooling suit is prepared by adhering a plurality of shaft-like members to a cloth and then cutting and sewing the cloth into said cooling suit.

22. A cooling suit of anyone of claims 1 through 5, wherein said power source means is a battery housed within a pocket formed at said reverse side or an outer side of said cloth part.

23. A cooling suit of anyone of claims 1 through 5, wherein said power source means is a secondary battery, and wherein said cooling suit further comprises a charging-aimed connecting portion provided at said cloth part so as to connect said secondary battery to an exterior power source upon charging said secondary battery.

24. A cooling suit of anyone of claims 1 through 5, wherein said cloth part is applied with a heat-ray reflecting treatment.

25. A cooling suit of anyone of claims 1 through 5, wherein said cloth part is made of plastics.

26. A cooling suit of anyone of claims 1 through 5, wherein said cloth part is fabricated of a stretchable material at least those portions of said cloth part which correspond to bent portions and/or uneven portions of the wearer's body, and wherein said stretchable material has a reverse side attached with multiple small pieces of said spacers.

27. A cooling suit of anyone of claims 1 through 5, further comprising:

detecting means for detecting the temperature near said air outlet or the temperature and humidity near said air outlet, and controlling means for controlling the revolution number of said air-blowing means based on the result detected by said detecting means.

28. A cooling suit of anyone of claims 1 through 5, further comprising:

adjusting means provided at said cloth part so as to adjust the length of said cloth part around the waist of the wearer.

29. A cooling suit of anyone of claims 1 through 5, further comprising:

air agitating means for agitating the air flowing within said airflow passage.

30. A cooling suit of anyone of claims 1 through 5, further comprising:

air guiding means provided within the or each spacer, so as to allow air to flow along a predetermined route within said airflow passage.

31. A cooling suit of anyone of claims 1 through 5, further comprising:

an ensuring member provided at or near said air-blowing means and protruded from the front side of said air-blowing means, so as to ensure the discharge and suck of air by said air-blowing means when a jacket is worn on said cloth part.

32. A cooling suit of anyone of claims 1 through 5, wherein the or each spacer is extended to a predetermined end of said cloth part and attached thereto, such that the opening end of the or each spacer at said end of said cloth part is utilized as said air inlet or said air outlet.

33. A cooling suit of anyone of claims 1 through 3, wherein said air-blowing means is provided at the lower side of said cloth part.

34. A cooling suit of anyone of claims 1 through 3, wherein said air-blowing means is provided at the substantially center position of said cloth part in the vertical direction, so as to cause air to flow in/out via said air inlet/outlet provided at the upper and lower sides of said cloth.

35. A cooling suit of anyone of claims 1 through 3, further comprising:

air inflow/outflow preventing means for preventing air inflow and air outflow via the bottom portion of said cloth part into/from said airflow passage.

36. A cooling suit of claim 35, wherein said air inflow/outflow preventing means comprises a string-like member provided at the bottom portion of said cloth part, such as to bind the ends of said string-like member or fix said string-like member by a fixture after wearing said cooling suit, to thereby cause the bottom portion of said cloth part to closely contact around the waist of the wearer.

37. A cooling suit of anyone of claims 1 through 3, wherein said cloth part has a bottom portion extended beyond the underbelly of the wearer, so that said bottom portion of said cloth part is brought into the trousers of the wearer to thereby prevent air from flowing in and out via said bottom portion of said cloth part into/from said airflow passage.

38. A cooling suit of anyone of claims 1 through 3, further comprising:

a fastener at the front portion of said cloth part.

39. A cooling suit of anyone of claims 1 through 3, further including:

a special-purpose jacket provided with urging means for urging the or each spacer, such that said special-purpose jacket is worn on said cloth part to thereby cause an undergarment of said wearer to closely contact with the wearer's body via the or each spacer by said urging means.

40. A cooling suit of anyone of claims 1 through 3, further comprising:

urging means for urging the or each spacer, said urging means being provided, at the position corresponding to a concave portion of the wearer's body, at the surface of said cloth part or between the cloth part and the or each spacer.

41. A cooling suit of anyone of claims 1 through 3, wherein said cloth part includes a stretchable material at the portion corresponding to the bust of a female wearer, which portion being provided with no spacers.

42. A cooling suit of anyone of claims 1 through 3, wherein said cloth part includes long sleeve portions each having a cuff portion closely contacted with the wrist of the wearer by an elastic member, and wherein said air-blowing means is provided near the cuff portion.

43. A cooling suit of claim 3, wherein said lining cloth is detachably provided at said reverse side of said cloth part.

44. A cooling suit of claim 3, wherein said lining cloth is a mesh material sewn to the circumference of the or each spacer.

45. A cooling suit of claim 4 or 5, wherein said air-blowing means is provided at that portion of said cloth part which portion corresponds to the underbelly or waist of the wearer, so as to cause air to flow in or out via bottom portion of said cloth part into or from said airflow passage.

46. A cooling suit to be worn by a wearer, comprising:

a cloth part; and at least one spacer provided at a predetermined position of a reverse side of said cloth part, so as to ensure an airflow passage between said cloth part and the wearer's body;

wherein the or each spacer is constituted to comprise a plurality of shaft-like members physically connected to one another, and the or each spacer has an opening ratio of 30% or more in the plane perpendicular to the air flowing direction, and wherein said cooling suit is worn onto a naked skin or undergarment of the wearer such that the or each spacer directly contacts with the naked skin or undergarment at that side of the or each spacer which side is opposite to the side contacting with said cloth part.

47. A cooling suit of claim 46, wherein the or each spacer has an opening ratio of 20% or more at the side of the or each spacer which contacts with the wearer's body.

48. A cooling suit of claim 46, wherein the or each spacer comprises:

a mesh member formed into a substantially flat shape, a plurality of pillar members, each pillar member having a length component in the thickness direction of said mesh member and each pillar member being physically joined to said mesh member at a predetermined intersection of said mesh member; and a plurality of connecting members each formed into a frame shape connecting those ends of the associated pillar members; and wherein said mesh member is arranged to oppose to said reverse side of said cloth part so that the or each spacer is sewn to said cloth part making use of those portions of said mesh member which are out of portions enclosed by said connecting members.

49. A cooling suit of claim 46, wherein the or each spacer is non-water-absorbing.

50. A cooling suit of claim 46, wherein the or each spacer is applied with an antibacterial treatment.

* * * * *